US009545813B2

(12) United States Patent
Fukumoto et al.

(10) Patent No.: US 9,545,813 B2
(45) Date of Patent: Jan. 17, 2017

(54) BALL PEN

(71) Applicant: MITSUBISHI PENCIL COMPANY, LIMITED, Tokyo (JP)

(72) Inventors: Takeo Fukumoto, Yokohama (JP); Seiichi Maruyama, Yokohama (JP); Kazuhiko Furukawa, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 104 days.

(21) Appl. No.: 14/405,661

(22) PCT Filed: Jun. 7, 2013

(86) PCT No.: PCT/JP2013/065782

§ 371 (c)(1),
(2) Date: Dec. 4, 2014

(87) PCT Pub. No.: WO2013/183744

PCT Pub. Date: Dec. 12, 2013

(65) Prior Publication Data

US 2015/0165812 A1 Jun. 18, 2015

(30) Foreign Application Priority Data

Jun. 7, 2012 (JP) ..... 2012-129644
Jun. 7, 2012 (JP) ..... 2012-129645

(51) Int. Cl.
*B43K 7/00* (2006.01)
*B43K 1/08* (2006.01)
(Continued)

(52) U.S. Cl.
CPC ..... *B43K 1/082* (2013.01); *B43K 1/08* (2013.01); *B43K 7/00* (2013.01); *B43K 7/005* (2013.01);
(Continued)

(58) Field of Classification Search
CPC ..... B43K 1/082; B43K 1/086; B43K 1/088; B43K 7/12; B43K 7/005; B43K 7/02
(Continued)

(56) References Cited

U.S. PATENT DOCUMENTS 3,960,455 A 6/1976 Balassiano
5,026,189 A 6/1991 Keil
(Continued)

FOREIGN PATENT DOCUMENTS

CN 2280010 Y 4/1998
CN 2419062 Y 2/2001
(Continued)

OTHER PUBLICATIONS

Office Action dated Oct. 29, 2015, issued in counterpart Chinese Application No. 201380041400.0, with English translation (15 pages).
(Continued)

*Primary Examiner* — Jennifer C Chiang
(74) *Attorney, Agent, or Firm* — Westerman, Hattori, Daniels & Adrian, LLP

(57) ABSTRACT

A ballpoint pen wherein an outer member (50) covering the outer circumference of a holder (21) covers a section that reaches as far as a narrowed section (23) of the holder (21) and has an outer member tip end portion (51). An ink spreads between the writing ball (30) and the contact section of the writing surface and between the outer member tip end portion (51) and the contact section of the writing surface, in which the writing ball (30) and the outer member tip end portion (51) are in contact with the writing surface at the same time. The relative position of the outer member (50) and the holder (21) can be changed from a holder protruding position to a holder retracted position wherein the writing ball (30) and the tip section of the outer member (50) can be in contact with the writing surface at the same time.

8 Claims, 40 Drawing Sheets

(51) Int. Cl.

| | |
|---|---|
| ***B43K 7/02*** | (2006.01) |
| ***B43K 7/10*** | (2006.01) |
| ***B43K 7/12*** | (2006.01) |
| ***B43K 23/12*** | (2006.01) |
| ***B43K 24/02*** | (2006.01) |

(52) U.S. Cl.
CPC . *B43K 7/02* (2013.01); *B43K 7/10* (2013.01); *B43K 7/12* (2013.01); *B43K 23/12* (2013.01); *B43K 24/023* (2013.01)

(58) Field of Classification Search
USPC ..... 401/209, 215, 216
See application file for complete search history.

(56) References Cited

U.S. PATENT DOCUMENTS

| | | | |
|---|---|---|---|
| 5,067,837 | A | 11/1991 | Panopoulos |
| 6,494,634 | B1 | 12/2002 | Inoue et al. |
| 2007/0168411 | A1 | 7/2007 | Hubert |
| 2010/0047004 | A1 | 2/2010 | Bedhome et al. |

FOREIGN PATENT DOCUMENTS

| | | | |
|---|---|---|---|
| DE | 1068152 | B | 10/1959 |
| DE | 1511403 | A1 | 6/1969 |
| JP | 48-044283 | Y1 | 12/1973 |
| JP | 52-009523 | A | 1/1977 |
| JP | 52-006348 | Y2 | 2/1977 |
| JP | 02-303896 | A | 12/1990 |
| JP | 08-006551 | Y2 | 2/1996 |
| JP | 08-187987 | A | 7/1996 |
| JP | 2000-343870 | A | 12/2000 |
| JP | 2006-289833 | A | 10/2006 |
| JP | 2007-510565 | A | 4/2007 |
| JP | 2007-520729 | A | 7/2007 |
| JP | 2009-143032 | A | 7/2009 |

OTHER PUBLICATIONS

Extended European Search Report dated Feb. 8, 2016, issued in counterpart European Patent Application No. 13800078.1 (7 pages).
International Search Report dated Jul. 16, 2013, issued in corresponding application No. PCT/JP2013/065782.

BALL PEN

TECHNICAL FIELD

The present invention relates to a ballpoint pen capable of changing the width of drawn lines.

BACKGROUND ART

Conventionally, as a technique related to a ballpoint pen capable of writing drawn lines having different widths using one writing shaft, as disclosed in Patent Literature 1, a technique of controlling the amount of ink leakage using a pressurizing mechanism provided in a rear end portion in a shaft tube to change a width and a thickness of a drawn line is known.

Moreover, as disclosed in Patent Literature 2, a technique of changing the width and thickness of drawn lines using a ballpoint pen in which pen tips having different ball diameters are attached to both ends of a writing shaft is also known.

Moreover, conventionally, as a technique related to a ballpoint pen capable of writing drawn lines having different widths using one writing tip, as disclosed in Patent Literature 3, a technique of providing a spring inside a holder so that a writing ball is always pressed toward the writing tip by the resilience of the spring and allowing lines of different widths to be drawn according to a writing load is known. Moreover, a writing instrument capable of moving a marking surface portion back and forth and writing a plurality of narrow and bold lines is also disclosed.

CITATION LIST

Patent Literature

Patent Literature 1: JP 2006-289833 A
Patent Literature 2: JP 08-6551 U
Patent Literature 3: JP 08-187987 A
Patent Literature 4: JP 2007-502729 A

SUMMARY OF INVENTION

Technical Problem

In the invention disclosed in Patent Literature 1, since a pressurizing mechanism is provided in a writing instrument, the writing instrument has a complex structure. Thus, it is difficult to adjust the pressing force of the pressurizing mechanism during writing, and a redundant amount of ink may leak.

Moreover, in the invention disclosed in Patent Literature 2, since only two types of pen tips are used in addition to the inconvenience to invert the writing shaft, it is possible to draw bold and narrow lines only. However, it is not possible to adjust the width of drawn lines.

Therefore, an object of the present invention is to provide a ballpoint pen which has a simple structure and which can write drawn lines of different widths using one writing tip without requiring special operations during writing and freely change the width of drawn lines.

Moreover, in the invention disclosed in Patent Literature 3, the gap between the writing ball and a narrowed portion of the holder is changed whereby the amount of ink leakage changes and the width and thickness of drawn lines change. The range where the writing ball can move within the holder is limited. Since a large amount of ink leaks if the movable distance is increased, it is difficult to draw lines satisfactorily. Due to this, there is a limit even when the line width is increased.

In the invention disclosed in Patent Literature 4, since lines are drawn using the surface of a component, it is difficult to provide smooth writing performance. Moreover, when a shiftable pin is replaced with a pen tip having a writing ball in order to provide smooth writing performance, ink leaking from the gap of the pen tip does not reach the marking surface portion. Thus, it is difficult to write narrow and bold lines having a plurality of widths.

Thus, another object of the present invention is to provide a ballpoint pen which can write drawn lines of different widths using one writing ball and a writing portion made up of two components while maintaining an optimal positional relation between a writing ball and a holder, freely change the width of drawn lines, and easily write characteristic drawn lines with strokes such as "stop," "hook," and "fade."

Solution to Problem

In order to solve the problems, the present invention has the following configurations.

(First Aspect of the Invention)

A first aspect of the present invention is a ballpoint pen configured to be capable of writing drawn lines of different widths using one writing tip. That is, the ballpoint pen includes: a writing ball; a holder that holds the writing ball by a narrowed portion with a narrow tip end; an ink supply portion that supplies ink to the holder; a shaft tube that stores the ink supply portion therein; and an outer member that covers an outer circumference of the holder, wherein a part of the holder holding the writing ball and a part of the outer member are exposed from a tip end portion of the shaft tube, and the writing ball and an outer member tip end portion form a writing portion.

(Second Aspect of the Invention)

A second aspect of the present invention is a ballpoint pen configured to be capable of writing drawn lines of different widths using one writing tip. That is, the ballpoint pen includes: a writing ball; a holder that holds the writing ball by a narrowed portion with a narrowed tip end; an ink supply portion that supplies ink to the holder; a shaft tube that stores the ink supply portion therein; and an outer member that is molded together with the shaft tube to form a tip end portion of the shaft tube and covers an outer circumference of the holder, wherein a part of the holder holding the writing ball is exposed from a tip end portion of the shaft tube, and the writing ball and an outer member tip end portion form a writing portion.

The shaft tube may be configured to capably store ink therein directly and may be configured to store a refill in which ink is filled. The ink supply portion may be configured to supply ink stored in the shaft tube to the holder with the aid of an intermediate member such as a collector and may be configured to supply ink stored in an ink storage tube such as a refill which is separated from the shaft tube to the holder.

The holder has a tip end which is exposed from the tip end portion (front shaft portion) of the shaft tube and has a rear end which is positioned inside the shaft tube and communicates with the ink supply portion. A ball house is formed in the tip end of the holder, and the writing ball is held in the ball house. The holder can be formed by cutting or injection-molding a metal material such as stainless steel or a resin material such as polyacetal.

The outer member is a tubular member that covers at least a portion of the holder exposed from the shaft tube and is preferably formed from a synthetic resin. The holder is covered with the outer member and only the narrowed portion is exposed from the outer member. Moreover, the outer member tip end portion is a tip end portion of the outer member and is configured to capably make contact with the writing surface substantially simultaneously with the writing ball. That is, the outer member tip end portion swells further toward the outer side (the outer circumference) than the narrowed portion, and the narrowed portion is at the same position as the tangent that touches both the writing ball and the outer member tip end portion or does not protrude toward the tip end.

In the ballpoint pen according to this aspect, when a user writes lines in a state where the shaft tube is approximately vertical to the writing surface (standing state) or in a state where the writing portion does not get into the writing surface, only the writing ball makes contact with the writing surface, and it is possible to draw lines having a predetermined width with the ink adhering to the periphery of the writing ball. On the other hand, when a user writes lines in a state where the shaft tube is inclined to some extent in relation to the writing surface (lying state) or in a state where the writing portion gets into the writing surface, the writing ball and the outer member tip end portion make contact with the writing surface simultaneously, and the ink adhering to the periphery of the writing ball and the ink leaking from the inside of the holder with rotation of the writing ball diffuse between the contact portion of the writing ball and the writing surface and the contact portion of the outer member tip end portion and the writing surface according to capillary phenomenon. Due to this, it is possible to draw lines having a larger width than when the shaft tube is in the standing state or the writing portion does not get into the writing surface.

According to this aspect, it is possible to draw lines of different widths by changing the contact state of the writing portion with the writing surface according to an inclination angle of the shaft tube during writing.

(Third Aspect of the Invention)

In a third aspect of the present invention, in addition to the configuration of the first or second aspect of the invention, the outer member covers a part of the holder until it reaches the narrowed portion.

The outer member tip end portion is configured to cover a portion of the holder reaching the narrowed portion, that is, the outer circumference located closer to the rear side than the narrowed portion.

According to this aspect, when the writing ball and the outer member make contact with the writing surface simultaneously, ink diffuses into the portion surrounded by the writing surface, the writing ball, and the outer member according to capillary phenomenon. Thus, it is possible to draw bold lines without blurring.

(Fourth Aspect of the Invention)

In a fourth aspect of the present invention, in addition to the configuration of the third aspect of the invention, the ink has such viscosity that the ink can diffuse between a contact portion of the writing ball with a writing surface and a contact portion of the outer member tip end portion with the writing surface, in a state where the writing ball and the outer member tip end portion are in contact with the writing surface simultaneously.

According to this aspect, when the writing ball and the outer member tip end portion make contact with the writing surface simultaneously, ink diffuses into the portion surrounded by the writing surface, the writing ball, and the outer member tip end portion according to capillary phenomenon. Thus, it is possible to draw bold lines without blurring.

Furthermore, in order to solve the problems, the present invention includes the following configuration.

(Fifth Aspect of the Invention)

A fifth aspect of the present invention is a ballpoint pen configured to capably write drawn lines of different widths using two writing portions. That is, the ballpoint pen includes: a writing ball; a first writing portion that holds the writing ball by a narrowed portion with a narrowed tip end; an ink supply portion that supplies ink to the first writing portion; a shaft tube that stores the ink supply portion therein; and a second writing portion that covers an outer circumference of the first writing portion, a part of the second writing portion and a part of the first writing portion holding the writing ball being exposed from a tip end portion of the shaft tube; a displacement means that capably changes a relative positional relation in an axial direction between the first writing portion and the second writing portion; wherein the displacement means is formed so that, when a relative position of the first writing portion in relation to the second writing portion is at a retracting position of the first writing portion, the first writing portion and a tip end portion of the second writing portion can make contact with the writing surface simultaneously.

(Sixth Aspect of the Invention)

A sixth aspect of the present invention is a ballpoint pen configured to capably write drawn lines of different widths using two writing portions. That is, the ballpoint pen includes: a writing ball; a first writing portion that holds the writing ball by a narrowed portion with a narrowed tip end; an ink supply portion that supplies ink to the first writing portion; a shaft tube that stores the ink supply portion therein; and a second writing portion that is molded together with the shaft tube to form a tip end of the shaft tube and covers an outer circumference of the first writing portion, a part of the first writing portion holding the writing ball being exposed from a tip end portion of the second writing portion; a displacement means that capably changes a relative positional relation in an axial direction between the first writing portion and the second writing portion; wherein the displacement means is formed so that, when a relative position of the first writing portion in relation to the second writing portion is at a retracting position of the first writing portion, the first writing portion and a tip end portion of the second writing portion can make contact with the writing surface simultaneously.

The shaft tube may be configured to be able to store ink therein directly and may be configured to store a refill in which ink is filled. The ink supply portion may be configured to supply ink stored in the shaft tube to the first writing portion with the aid of an intermediate member such as a collector and may be configured to supply ink stored in an ink storage tube such as an ink refill which is separated from the shaft tube to the first writing portion.

The first writing portion can be formed by cutting or injection-molding a metal material such as stainless steel or a resin material such as polyacetal. The first writing portion has a tip end which is exposed from the tip end portion (front shaft portion) of the shaft tube and has a rear end which is positioned inside the shaft tube and communicates with the ink supply portion. A ball house is formed in the tip end of the first writing portion, and the writing ball is held in the ball house.

The second writing portion is a tubular member that covers at least a portion of the first writing portion exposed from the shaft tube and is preferably formed from a synthetic resin. The tip end portion of the second writing portion indicates a tip end portion of the second writing portion and is configured to cover a portion of the first writing portion reaching the narrowed portion, that is, the outer circumference located closer to the rear side than the narrowed portion.

The displacement means is configured to capably change the relative position of the first writing portion and the second writing portion. This aspect includes two cases: a case where the second writing portion may be so formed as to be movable in relation to the first writing portion so that the second writing portion is displaced by the displacement means; and another case where the first writing portion may be so formed as to be movable in relation to the second writing portion so that the first writing portion is displaced by the displacement means. The displacement means may be an elastic member which can move the first writing portion or the second writing portion in the axial direction by being compressed and deformed when load is applied from the tip end thereof and a mechanism which can move the first writing portion or the second writing portion in the axial direction according to a predetermined operation.

In this aspect, when the positional relation between the first writing portion and the second writing portion is such that the first writing portion is at the retracting position in relation to the second writing portion, the portion of the first writing portion reaching the narrowed portion is covered with the second writing portion whereby the writing ball and the narrowed portion are exposed from the second writing portion. In this case, the tip end portion of the second writing portion can make contact with the writing surface simultaneously with the writing ball. That is, when the first writing portion is at the retracting position, the narrowed portion is at the same position as the tangent that touches both the writing ball and the tip end portion of the second writing portion or does not protrude further toward the tip end.

On the other hand, when the positional relation between the first writing portion and the second writing portion is such that the first writing portion is at the protruding position in relation to the second writing portion, a portion of the first writing portion located closer to the rear side than the narrowed portion is covered with the second writing portion, whereby the narrowed portion and the portion located closer to the rear side than the narrowed portion are exposed from the second writing portion. In this case, the tip end portion of the second writing portion does not make contact with the writing surface simultaneously with the writing ball. That is, when the first writing portion is at the protruding position, the tip end portion of the second writing portion does not protrude closer to the tip end than the tangent that touches both the writing ball and the narrowed portion.

In the ballpoint pen of this aspect, when the relative position of the first writing portion and the second writing portion is at the protruding position of the first writing portion, only the writing ball makes contact with the writing surface, and it is possible to draw lines having a predetermined width with the ink adhering to the periphery of the writing ball. On the other hand, when the relative position of the first writing portion and the second writing portion is at the retracting position of the first writing portion, and a user writes lines in a state where the writing ball and the tip end portion of the second writing portion are in contact with the writing surface simultaneously, the ink adhering to the periphery of the writing ball and the ink leaking from the inside of the first writing portion with rotation of the writing ball diffuse between the contact portion of the writing ball and the writing surface and the contact portion of the tip end portion of the second writing portion and the writing surface according to capillary phenomenon. Due to this, it is possible to draw lines having a larger width than when a user writes lines in a state where only the writing ball is in contact with the writing surface.

According to the sixth aspect of the invention, it is possible to draw lines of different widths while maintaining an optimal positional relation between the writing ball and the first writing portion.

(Seventh Aspect of the Invention)

A seventh aspect of the present invention includes the following configuration in addition to the configuration of the fifth or sixth aspect of the invention. That is, the displacement means is an elastic member disposed on a rear side of the first writing portion and is capable of displacing the relative position of the first writing portion in relation to the second writing portion between a retracting position of the first writing portion at which the tip end portion of the second writing portion covers a portion of the writing ball reaching the narrowed portion and a protruding position of the first writing portion at which the tip end portion of the second writing portion is located closer to the rear side than the retracting position of the first writing portion (the opposite side to the tip end portion), and the displacement means is so formed that, when load is applied to the first writing portion from the tip end thereof at an initial position at which the first writing portion is at the protruding position, the elastic member is compressed and deformed, whereby the first writing portion is moved toward the rear side and the first writing portion is moved to the retracting position of the first writing portion.

This aspect specifies the displacement means of the sixth aspect of the invention.

The displacement means is configured to capably change the relative position of the first writing portion and the second writing portion between the retracting position of the first writing portion and the protruding position of the first writing portion.

The elastic member may be a member that restores according to elastic action such as rubber or a spring. In this aspect, the first writing portion is so formed as to be displaceable in relation to the shaft tube and the second writing portion, and the first writing portion moves to the holder retracting position when writing load is applied to the first writing portion from the tip end thereof. The writing load is applied to the first writing portion from the tip end, for example, when the writing ball is pressed against the writing surface and when the writing load is increased during writing. Moreover, when the writing load applied to the first writing portion disappears, the elastic member restores the original shape due to elasticity and the first writing portion returns to the initial position.

According to this aspect, it is possible to draw lines of different widths by changing the writing load.

Moreover, when the elastic member is configured as a soft member having low elastic modulus, elderly persons and kids who are weak can draw bold lines when writing lines at an optional angle regardless of writing load.

Further, when the load required for moving the first writing portion from the protruding position to the retracting position is very smaller than the writing load, the first writing portion is moved to the retracting position without causing any discomfort during writing and it is possible to draw bold lines constantly. Moreover, when the writing portion becomes distant from the writing surface for example, when a user creates strokes such as "hook" and "fade" and the writing load decreases, the first writing portion continuously moves from the retracting position to the protruding position, whereby a bold line changes to a narrow line continuously and smoothly.

Moreover, by changing a volume associated with deformation of the shape of the elastic member to allow an ink passage to be pressed by the writing load, it is possible to provide satisfactory ink flowability during initial writing.

(Eighth Aspect of the Invention)

An eighth aspect of the present invention includes the following configuration in addition to the configuration of the fifth or sixth aspect of the invention. That is, the displacement means is a feeding mechanism provided in the tip end portion of the shaft tube, and the feeding mechanism is so formed as to capably move the second writing portion between the protruding position of the first writing portion and the retracting position of the first writing portion according to a predetermined operation.

This aspect specifies the displacement means of the sixth aspect of the invention.

The feeding mechanism has at least a portion which is united or engaged with the second writing portion and can move the second writing portion in the axial direction according to a predetermined operation. The "predetermined operation" means externally operating a portion of the feeding mechanism or the second writing portion and includes rotating or sliding an operating subject. For example, the feeding mechanism may be a rotary feeding mechanism which includes a protrusion provided on the outer circumference of the second writing portion and a cylindrical cam provided on the inner circumference of the tip end portion of the shaft tube, and in which an operating portion coupled to the cylindrical cam and disposed outside the shaft tube 10 is so rotated that the second writing portion can be moved in the axial direction. Alternatively, a male screw and a female screw may be formed between the second writing portion and the inner portion of the tip end portion of the shaft tube, and the second writing portion may be rotated so that the second writing portion is moved in the axial direction.

In this aspect, the feeding mechanism functions based on an operation mode, and it is possible to move the second writing portion at the retracting position of the first writing portion to the protruding position of the first writing portion and to move the second writing portion at the protruding position of the first writing portion to the retracting position of the first writing portion.

According to this aspect, before a user writes lines, it is possible to set the writing tip state of the ballpoint pen to a state where narrow lines can be drawn or a state where bold lines can be drawn. Thus, it is not necessary to change the writing load or the writing tip angle in the middle of writing and it is possible to draw bold and narrow lines with constant writing load and angle.

(Ninth Aspect of the Invention)

A ninth aspect of the present invention includes the following configuration in addition to the configuration of the eighth aspect of the invention. That is, the ink has such viscosity that the ink can diffuse between a contact portion of the writing ball with a writing surface and a contact portion of the tip end portion of the second writing portion with the writing surface in a state where the writing ball and the tip end portion of the second writing portion are in contact with the writing surface simultaneously.

According to this aspect, when the writing ball and the tip end portion of the second writing portion make contact with the writing surface simultaneously, ink diffuses into the portion surrounded by the writing surface, the writing ball, and the tip end portion of the second writing portion according to capillary phenomenon. Thus, it is possible to draw bold lines without blurring.

Advantageous Effects of Invention

Since the present invention has the above-described configuration, it is possible to provide a ballpoint pen which has a simple structure and which can write drawn lines of remarkably different widths using one writing tip without requiring special operations during writing. Moreover, since it is possible to create high-quality strokes such as "stop," "hook," and "fade" easily by changing an inclination angle of a shaft tube during writing, it is possible to improve expressive power of handwriting.

Moreover, since the present invention has the above-described configuration, it is possible to provide a ballpoint pen which can write drawn lines of different widths using one writing tip while maintaining an optimal positional relation between a writing ball and a holder. Moreover, it is possible to freely change the width of drawn lines by changing writing load and optimizing a displacement means and create high-quality strokes such as "stop," "hook," and "fade" easily. Thus, it is possible to improve expressive power of handwriting.

BRIEF DESCRIPTION OF DRAWINGS

FIGS. 4A and 4B are vertical cross-sectional views of the tip portion of the ballpoint pen illustrating the state during writing according to the first embodiment, among which FIG. 4A illustrates the state where the shaft is inclined by a° with respect to a writing surface and FIG. 4B illustrates the state where the shaft is inclined by b° with respect to the writing surface.

FIGS. 11A and 11B are vertical cross-sectional views of the tip portion of the ballpoint pen illustrating the state during writing according to the second embodiment, among which FIG. 11A illustrates the state where the shaft is inclined by a° with respect to a writing surface and FIG. 11B illustrates the state where the shaft is inclined by b° with respect to the writing surface.

FIGS. 23A and 23B are front views illustrating the state during writing according to the sixth embodiment, among which FIG. 23A illustrates a normal state and FIG. 23B illustrates a state where a writing load is applied.

FIGS. 28A and 28B are front views illustrating the state during writing according to the seventh embodiment, among which FIG. 28A illustrates a normal state and FIG. 28B illustrates a state where an outer member protrudes.

FIGS. 36A and 36B are vertical cross-sectional views illustrating the state during writing according to the eleventh embodiment, among which FIG. 36A illustrates a normal state and FIG. 36B illustrates a state where a writing load is applied.

DESCRIPTION OF EMBODIMENTS

Hereinafter, first to fourteenth embodiments of the present invention will be described with reference to the drawings. In the present specification, "front side" of a ballpoint pen 1 and the constituent components thereof is a tip side when a writing ball 30 is a tip end of the ballpoint pen 1, and "rear side" is the opposite side.

(First Embodiment)

Figure 1A:
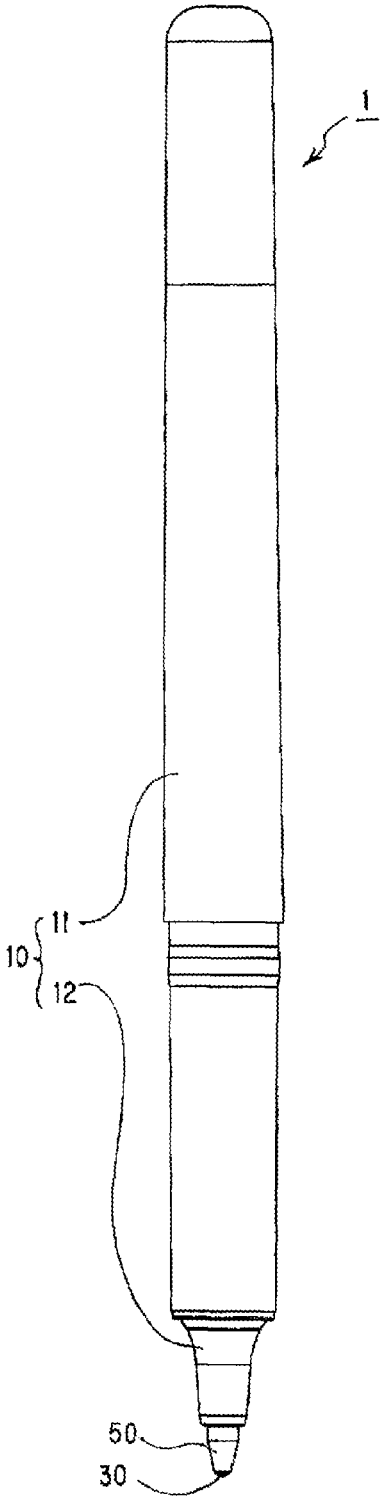
FIGS. 1A and 1B are a front view and a vertical cross-sectional view of a ballpoint pen according to a first embodiment of the present invention, respectively.
Figure 1B:
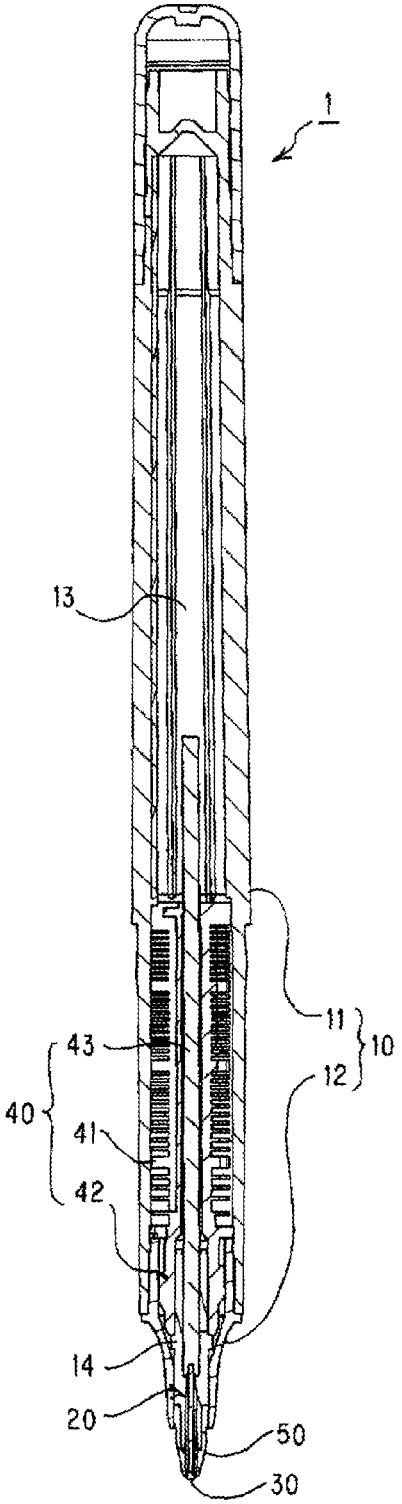

As illustrated in FIGS. 1A and 1B, the ballpoint pen 1 according to the first embodiment includes a pen tip 20 that has a writing ball 30 and a holder 21 that holds the writing ball 30 using a narrowed portion 23 (see FIG. 3) that has a narrowed tip end, an ink supply portion 40 that supplies ink to the holder 21 of the pen tip 20, a shaft tube 10 that stores the ink supply portion 40 therein, and an outer member 50 that covers an outer circumference of the holder 21.

As illustrated in FIG. 1B, the shaft tube 10 includes a shaft body 11 having an ink storage portion 13 and a front shaft portion 12 provided at a tip end of the shaft body 11, and the ink supply portion 40 and a joint 14 that connects the ink supply portion 40 and the pen tip 20 are included on a tip end side of the shaft body 11. Ink (not illustrated) is filled in the ink storage portion 13.

The ink supply portion 40 has an approximately tubular collector 41 in which a plurality of fins are formed on an outer circumference thereof and a tip holding portion 42 formed by narrowing a tip end of the collector 41. A rear end portion of the collector 41 is in contact with the ink storage portion 13, and the tip holding portion 42 is fitted into the front shaft portion 12. Moreover, a rear end portion of the joint 14 is fitted into the tip holding portion 42. Moreover, a rod-shaped collector core 43 made from polyester fiber passes in an axial direction of the collector 41. A rear end of the collector core 43 protrudes into the ink storage portion 13, and a tip end portion of the collector core 43 protrudes further toward the tip end than the tip holding portion 42 and is inserted inside from the rear end portion of the joint 14.

Figure 2:
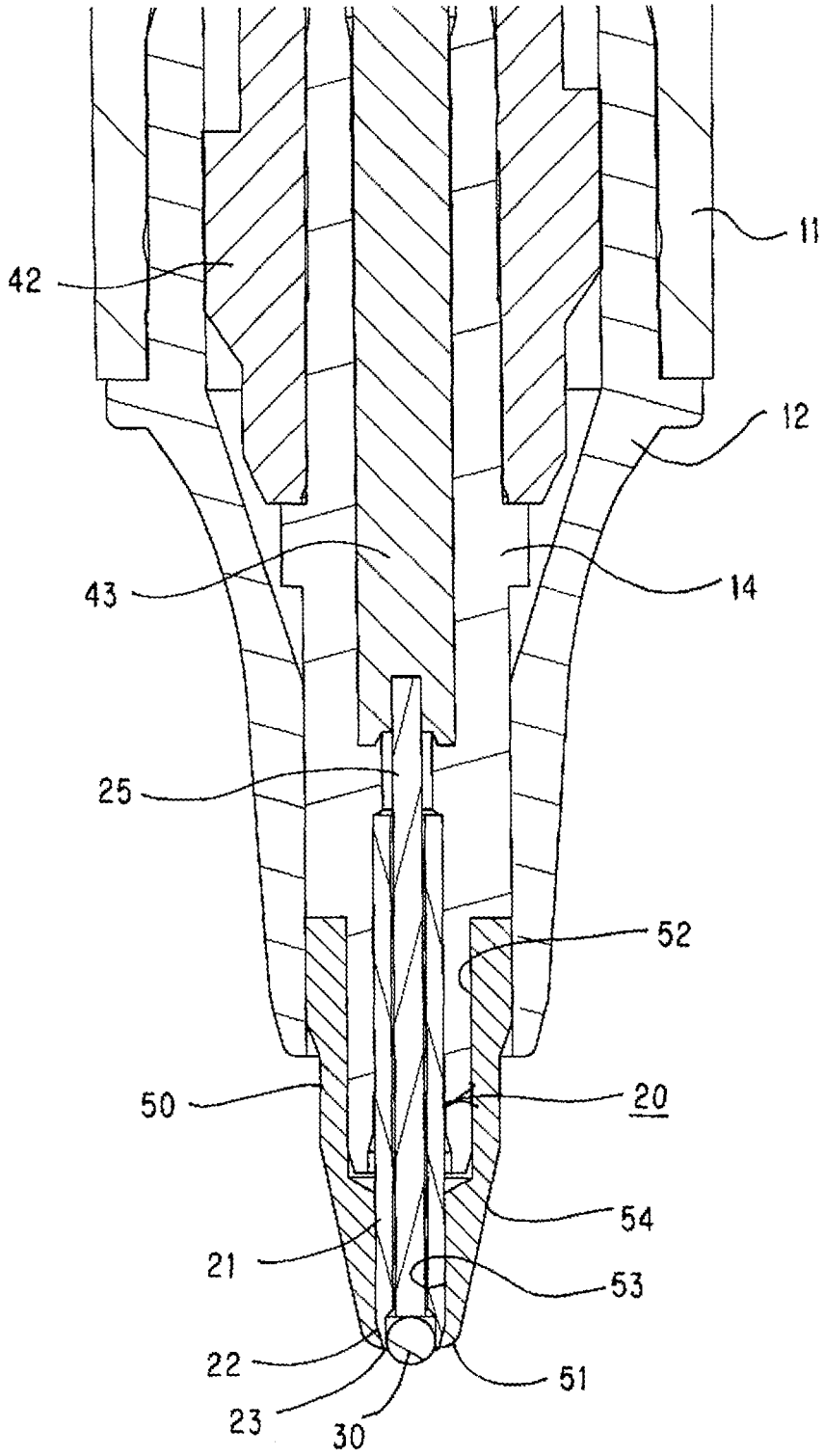
FIG. 2 is a vertical cross-sectional view of a tip portion of the ballpoint pen according to the first embodiment.

As illustrated in FIG. 2, the pen tip 20 includes the cylindrical holder 21 and the writing ball 30 held in the holder 21. An approximately conical tapered portion 22 which is narrowed toward the tip end is formed on a tip end side of the holder 21, and the narrowed portion 23 deformed by pressing an opening edge of the tapered portion 22 toward the inner side to reduce the diameter of the opening edge is formed on the tip end side. Further, a tip end portion of the writing ball 30 held in a ball house 24 (see FIG. 3) that is formed in an inner side of the tapered portion 22 is exposed from a tip edge of the narrowed portion 23. The holder 21 can be formed by processing a pipe material made from metal such as stainless steel and a resin such as polyacetal. Moreover, a rod-shaped central core 25 that protrudes from the rear end portion of the holder 21 is inserted into the holder 21. The central core 25 is formed from polyester fiber similarly to the collector core 43 and has a rear end that is fitted into the tip end portion of the collector core 43 and a tip end that reaches the rear end of the writing ball 30. The central core 25 absorbs ink entering into the collector core 43 to supply ink to the ball house 24. As illustrated in FIG. 2, the pen tip 20 is held in the joint 14 in a state where a portion of the pen tip 20 corresponding to approximately ⅔ of the entire length from the rear end side is fitted into the tip end portion of the joint 14.

Further, the collector core 43 and the central core 25 are formed by appropriately selecting the porosity and the surface shape of polyester fiber according to a property such as viscosity of ink used.

The outer member 50 is an approximately conical tube made from a synthetic resin, and as illustrated in FIG. 2, has a tapered portion 54 that is tapered toward the tip end. A round-chamfered outer member tip end portion 51 is formed in a tip end portion of the tapered portion 54. Further, the outer member tip end portion 51 may be taper-chamfered so as to have an inclined surface rather than being round-chamfered. Moreover, the outer member 50 has a rear insertion hole 52 formed on the rear side and a front insertion hole 53 that passes from the rear insertion hole 52 to the tip end side and has a smaller diameter than the rear insertion hole 52. The tip end portion of the joint 14 is inserted into the rear insertion hole 52, and the holder 21 of the pen tip 20 protruding from the joint 14 is inserted into the front insertion hole 53. Further, the outer member 50 is configured to be fixed to the tip end portion of the joint 14 to cover the joint 14 and the holder 21 exposed from the front shaft portion 12 in a state where the holder 21 is inserted into the front insertion hole 53 and the tip end portion of the joint 14 is inserted into the rear insertion hole 52.

Figure 3:
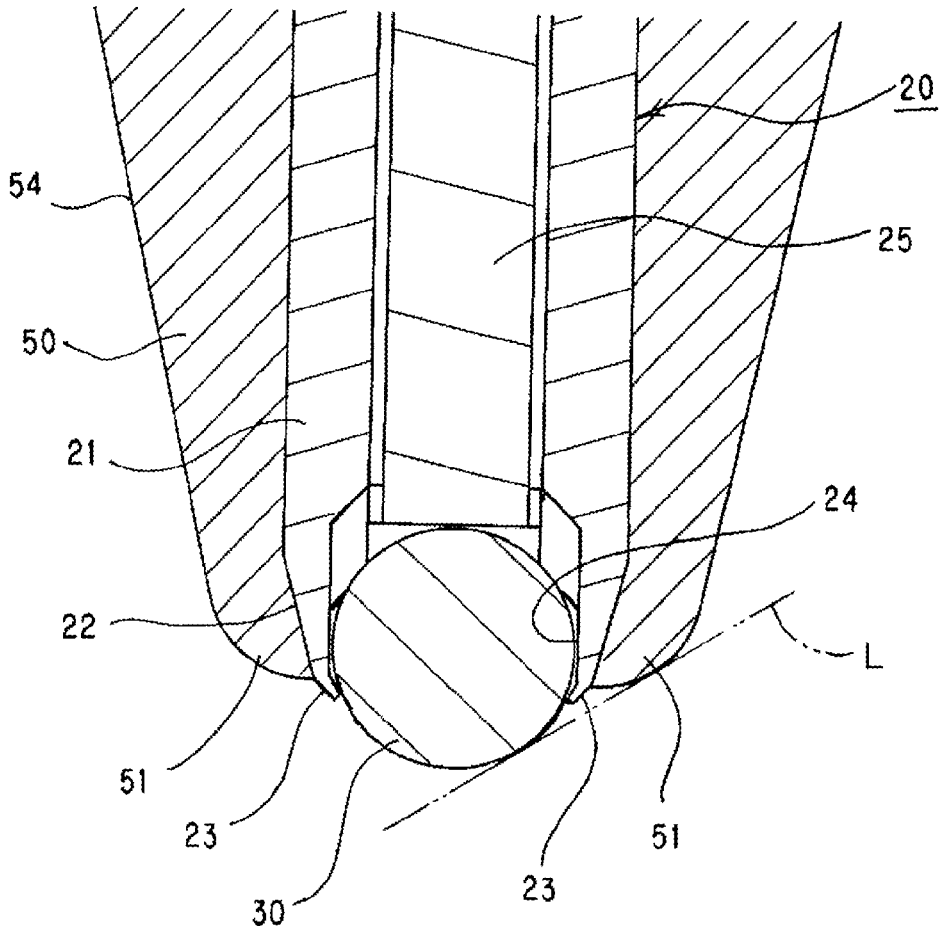
FIG. 3 is a vertical cross-sectional view of a writing tip of the ballpoint pen according to the first embodiment.

Moreover, when the outer member 50 is fixed to the joint 14, as illustrated in FIG. 3, a portion of the outer member tip end portion 51 closest to the tip end side (an edge portion of the front insertion hole 53 close to the tip end side) is positioned at a position that slightly exceeds a boundary line between the tapered portion 22 and the narrowed portion 23 of the holder 21. That is, the outer member 50 covers a portion extending up to the narrowed portion 23 of the holder 21. Due to this, as illustrated in FIGS. 1A, 1B, and 2, a portion of the outer member 50 corresponding to approximately ⅔ of the entire length close to the tip end, the narrowed portion 23 of the holder 21, and a portion of the writing ball 30 are exposed from the tip end of the front insertion hole 12. Further, the outer member may be fixed to the joint 14 and may be integrated with the front shaft portion 12.

In this example, as illustrated in FIG. 3, the outer member tip end portion 51 of the outer member 50 is formed in such a shape as to swell from the outer surface of the narrowed portion 23 so that the narrowed portion 23 is positioned on the inner side (closer to the writing ball 30) than a tangent L that touches both the outer member tip end portion 51 and the writing ball 30. That is, the outer member tip end portion 51 is formed such that the narrowed portion 23 does not protrude toward the front side further than the tangent L. Due to this, when the writing ball 30 and the outer member tip end portion 51 come into contact with a writing surface simultaneously, ink adhering to the surface of the writing ball 30 and ink leaking from the ball house 24 with rotation of the writing ball 30 diffuse into a space portion between a contact portion of the writing ball 30 and the writing surface and a contact portion of the outer member tip end portion 51 and the writing surface according to capillary phenomenon. Thus, it is possible to draw bolder lines as compared to when the writing ball 30 and the outer member tip end portion 51 do not come into contact with the writing surface simultaneously.

In the present embodiment, relatively low-viscosity ink capable of diffusing between the contact portion of the writing ball 30 and the writing surface and the contact portion of the outer member tip end portion 51 and the writing surface in a state where the writing ball 30 and the outer member tip end portion 51 are in contact with the writing surface simultaneously is used. The use of such ink prevents blurring even when bold lines are drawn.

A method of using the ballpoint pen 1 having the above-described configuration will be described based on FIGS. 4A and 4B to FIG. 6.

Figure 4A:
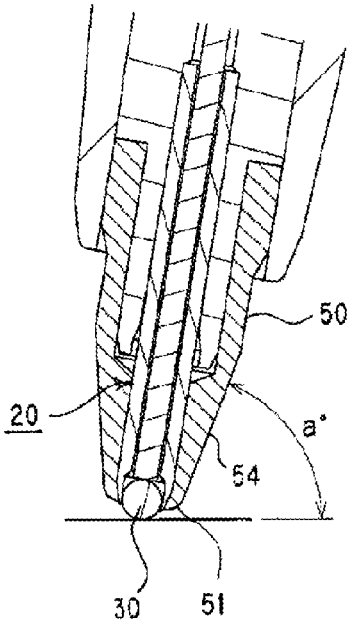
Figure 5:
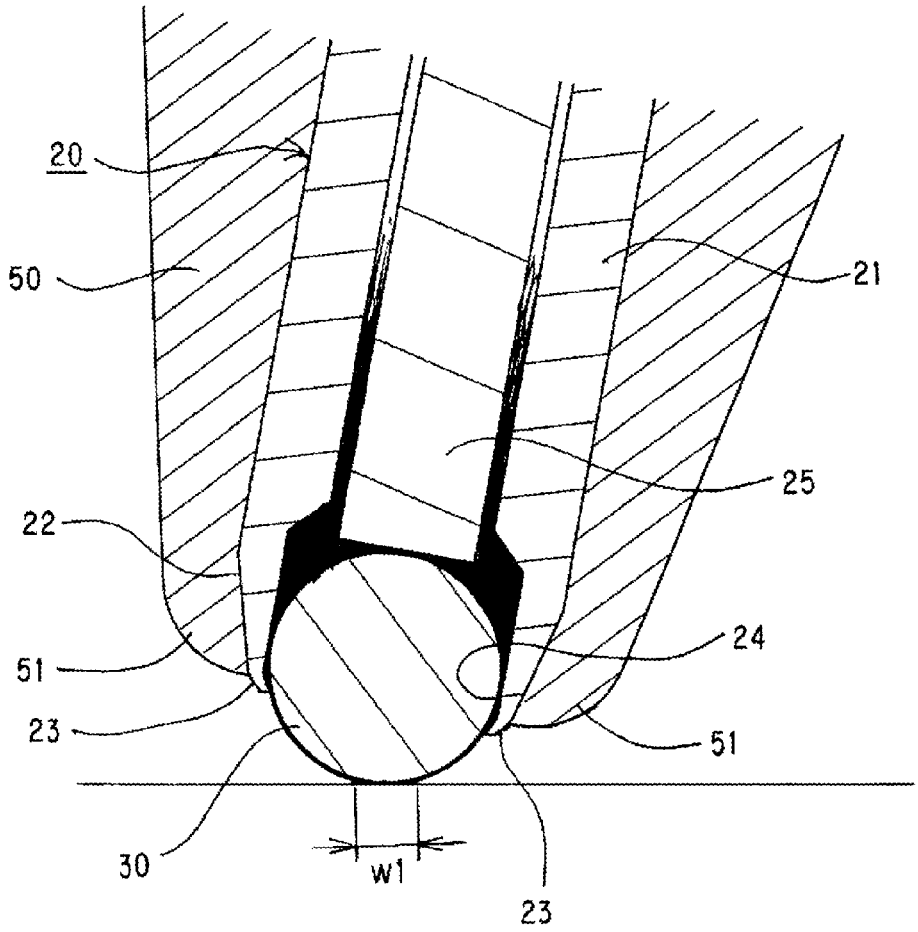
FIG. 5 is an enlarged view of a portion of FIG. 4A.

When the ballpoint pen 1 is so inclined that an angle of the tapered portion 54 of the outer member 50 in relation to the writing surface is a° as illustrated in FIG. 4A, it is possible to allow the writing ball 30 only to make contact with the writing surface as illustrated in FIG. 5. When a user writes lines with the ballpoint pen 1 inclined at such an angle, it is possible to draw a line having the width w1 with the ink adhering to the surface of the writing ball 30.

Figure 4B:
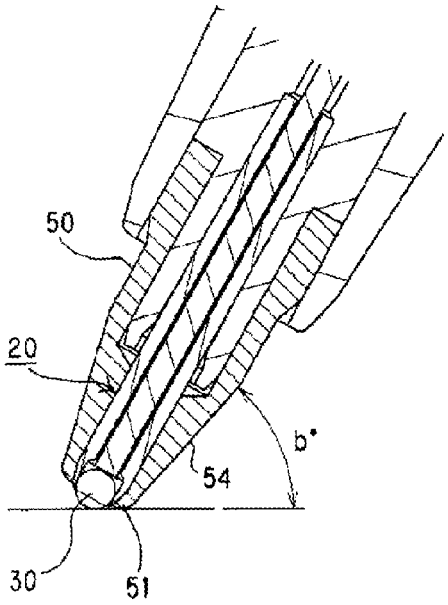
Figure 6:
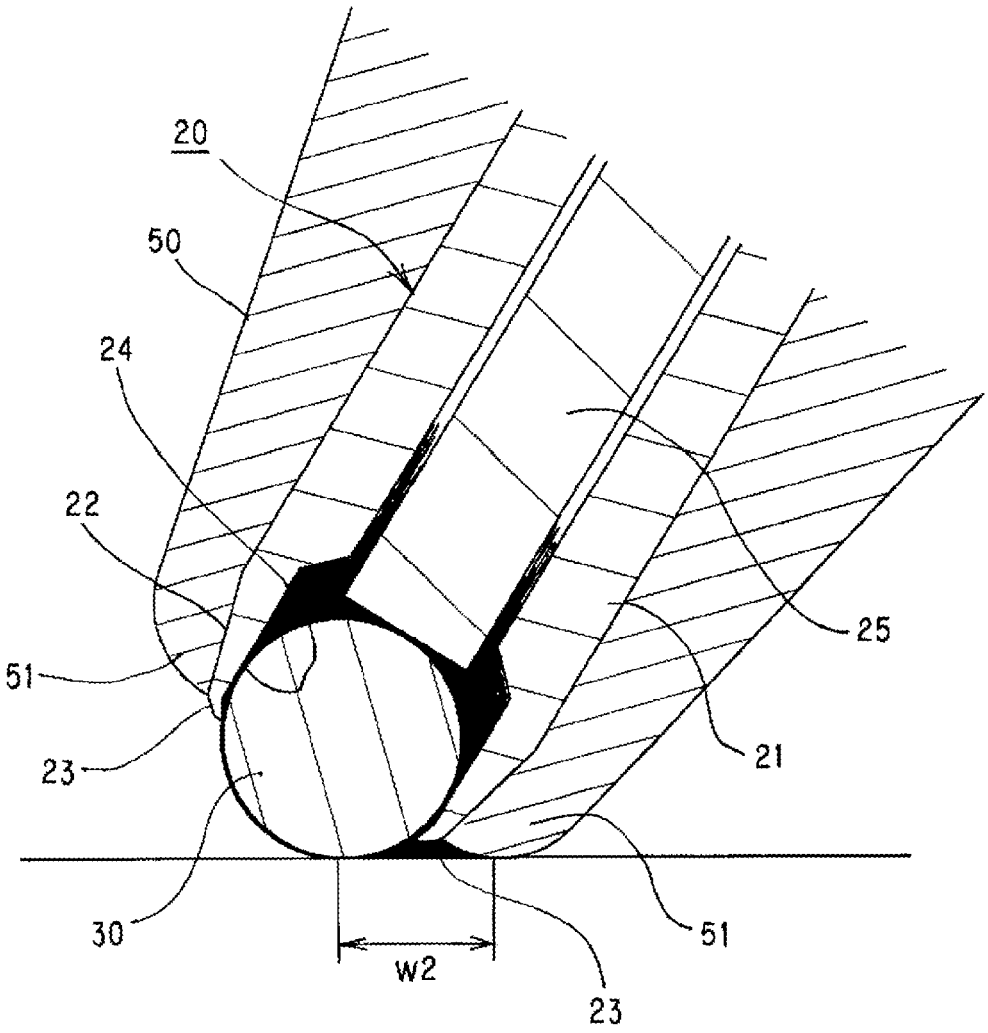
FIG. 6 is an enlarged view of a portion of FIG. 4B.

On the other hand, when the ballpoint pen 1 is so inclined that the angle of the tapered portion 54 of the outer member 50 in relation to the writing surface is b° smaller than a° as illustrated in FIG. 4B, it is possible to allow the writing ball 30 and the outer member tip end portion 51 to make contact with the writing surface simultaneously as illustrated in FIG. 6. In this state, the ink adhering to the surface of the writing ball 30 diffuses to the writing surface according to capillary phenomenon to adhere to the outer member tip end portion 51, and ink remains in the space portion surrounded by the writing ball 30, the writing surface, the outer member tip end portion 51, and the narrowed portion 23. Further, when a user writes lines in such a state, the ink leaks into the space portion with rotation of the writing ball 30 and it is possible to draw a line having the width w2 wider than the width w1 with the ink diffusing between the contact portion of the writing ball 30 and the writing surface and the contact portion of the outer member tip end portion 51 and the writing surface. In this case, since the positional relation between the writing ball 30 and the narrowed portion 23 is maintained, it is possible to maintain the amount of ink leaking with rotation of the writing ball 30 to be constant and to prevent ink leakage. Moreover, a contacting state of the tip end portion on the sheet surface may be changed as well as the angle of the contact portion in relation to the writing surface. For example, when a user writes lines while weakening load in a state where a plurality of sheets overlaps, only the writing ball makes contact with the writing surface. Thus, it is possible to write a line having the width w1. When a user writes lines while strengthening load in the same state, the writing ball and the outer member tip end portion can make contact with the writing surface simultaneously. Thus, it is possible to write a line having the width w2 remarkably wider than the width w1.

As described above, the ballpoint pen 1 according to the present embodiment can change the width of drawn lines remarkably just by changing the angle in relation to the writing surface during writing and the contacting state of the writing portion on the sheet surface and gradually narrow drawn lines with strokes such as "stop," "hook," and "fade." That is, when a user draws narrow lines, the user may put the shaft tube 10 in a close-to-vertical state (standing state) as illustrated in FIG. 4A. When a user draws bold lines, the user may put the shaft tube 10 in a more inclined state (lying state) than when the user draws narrow lines as illustrated in FIG. 4B.

Further, by adjusting the shape (the amount of protrusion toward the front side or the lateral side) of the outer member tip end portion 51 of the outer member 50, it is possible to equalize the line width when the writing ball 30 and the outer member tip end portion 51 make contact with the writing surface simultaneously, even when the writing ball 30 has a different ball diameter.

(Second Embodiment)

FIGS. 7A and 7B to FIG. 13 illustrate the second embodiment of the present invention. In the second embodiment, the same constituent components as those of the first embodiment will be denoted by the same reference numerals as those used in the first embodiment. The same goes for the third to fifth embodiments.

Figure 7A:
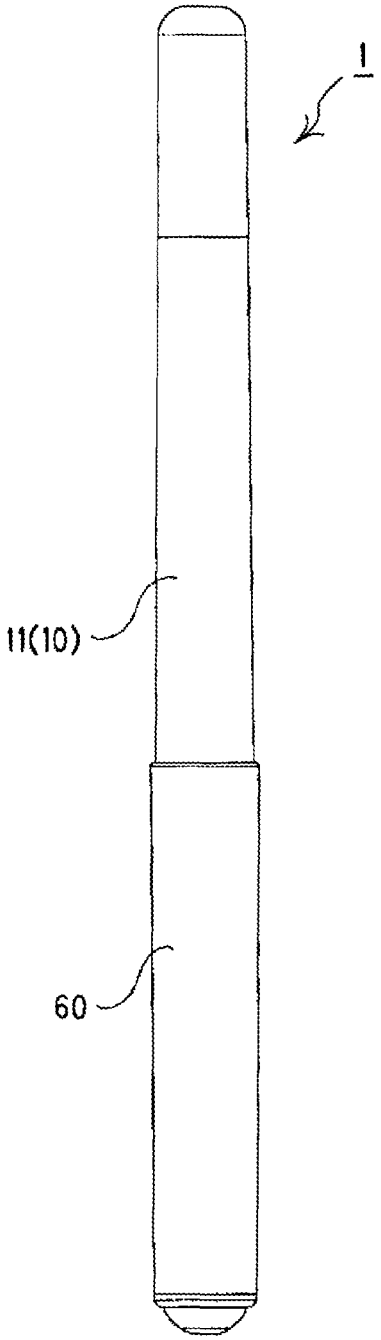
FIGS. 7A and 7B are a front view and a vertical cross-sectional view of a ballpoint pen according to a second embodiment of the present invention, respectively.
Figure 7B:
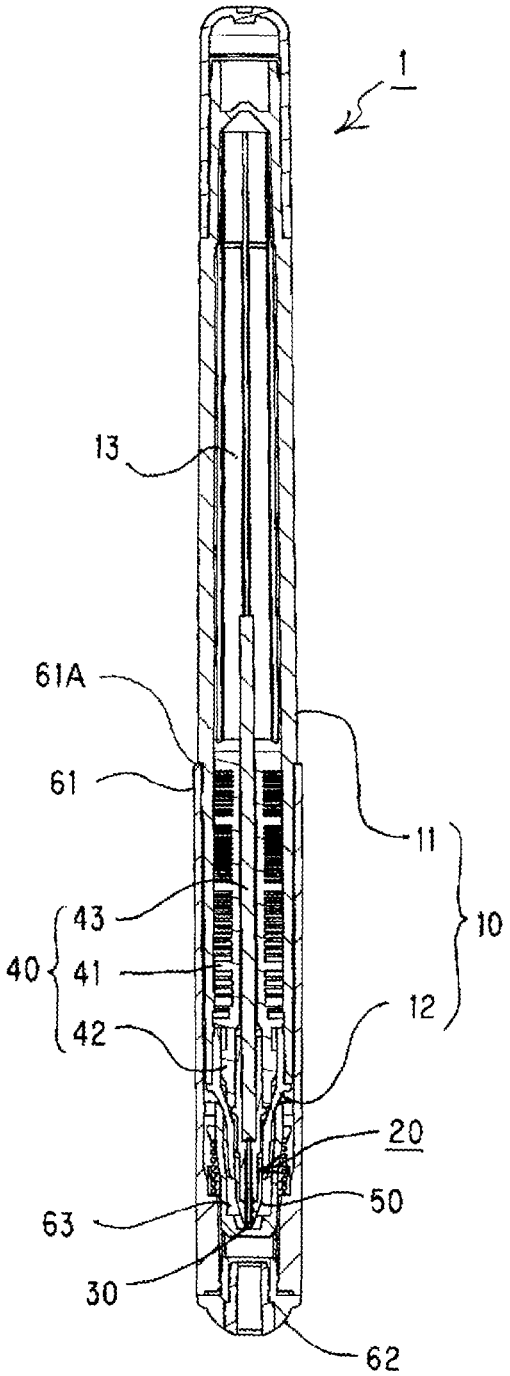
Figure 8A:
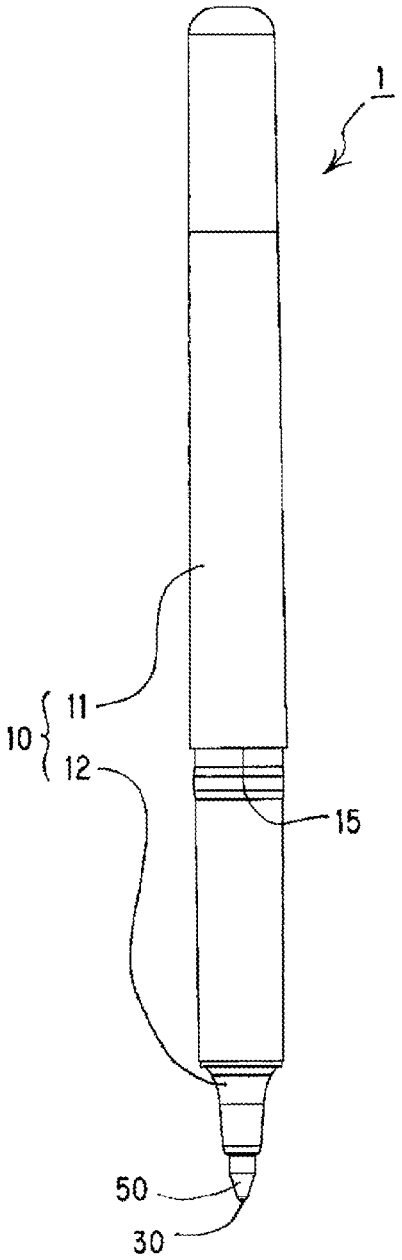
FIGS. 8A and 8B are a front view and a vertical cross-sectional view illustrating the state where a cap is removed according to the second embodiment, respectively.
Figure 8B:
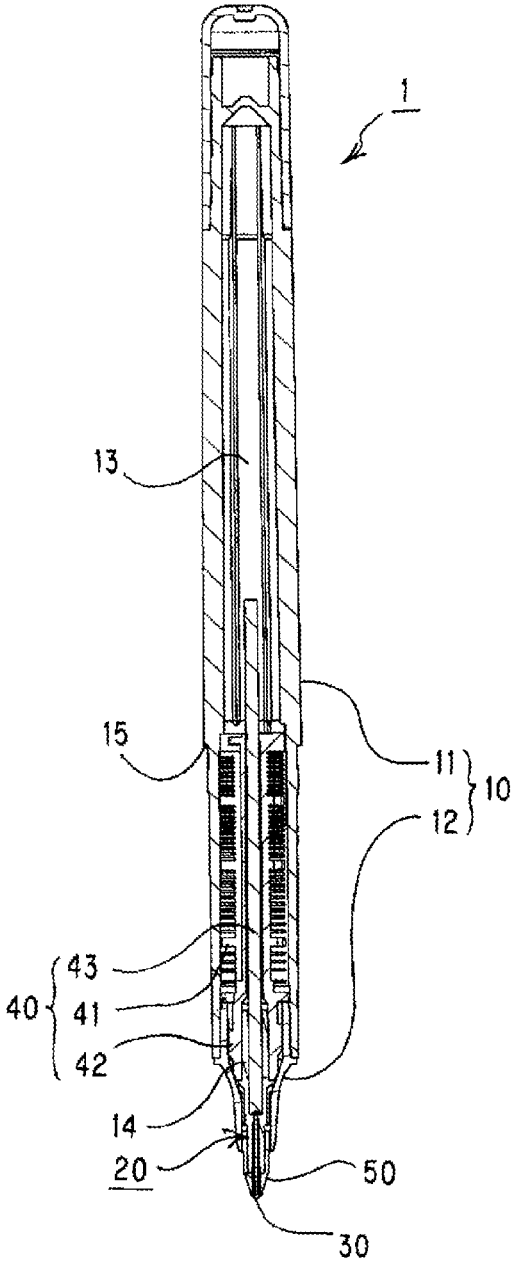

As illustrated in FIGS. 7A and 7B, a ballpoint pen 1 according to the second embodiment includes a pen tip 20 that has a writing ball 30 and a holder 21 that holds the writing ball 30 using a narrowed portion 23 (see FIG. 9) that has a narrowed tip end, an ink supply portion 40 that supplies ink to the holder 21 of the pen tip 20, a shaft tube 10 that stores the ink supply portion 40 therein, and an outer 50 that covers an outer circumference of the holder 21. Moreover, the ballpoint pen 1 includes a cap 60 for protecting the tip end portion of the pen tip 20. Hereinafter, redundant description of portions overlapping those of the first embodiment will not be provided, and features of the present embodiment will be described.

As illustrated in FIG. 7A, the cap 60 covers a portion of the shaft tube 10 corresponding to approximately ⅓ of the entire length close to the tip end side. As illustrated in FIG. 7B, the cap 60 includes a tube 61 made from a synthetic resin and a lid member 62 that is fitted from the tip end side of the tube 61, and a pen tip receiving portion 63 is provided in the cap 60. When the cap 60 covers the tip end portion of the shaft tube 10, a rear end portion 61A of the tube 61 is locked at an end portion 15 (see FIGS. 8A and 8B) formed by narrowing the diameter of the shaft body 11 and the tip end portion of the pen tip 20 is positioned in the pen tip receiving portion 63.

Figure 9:
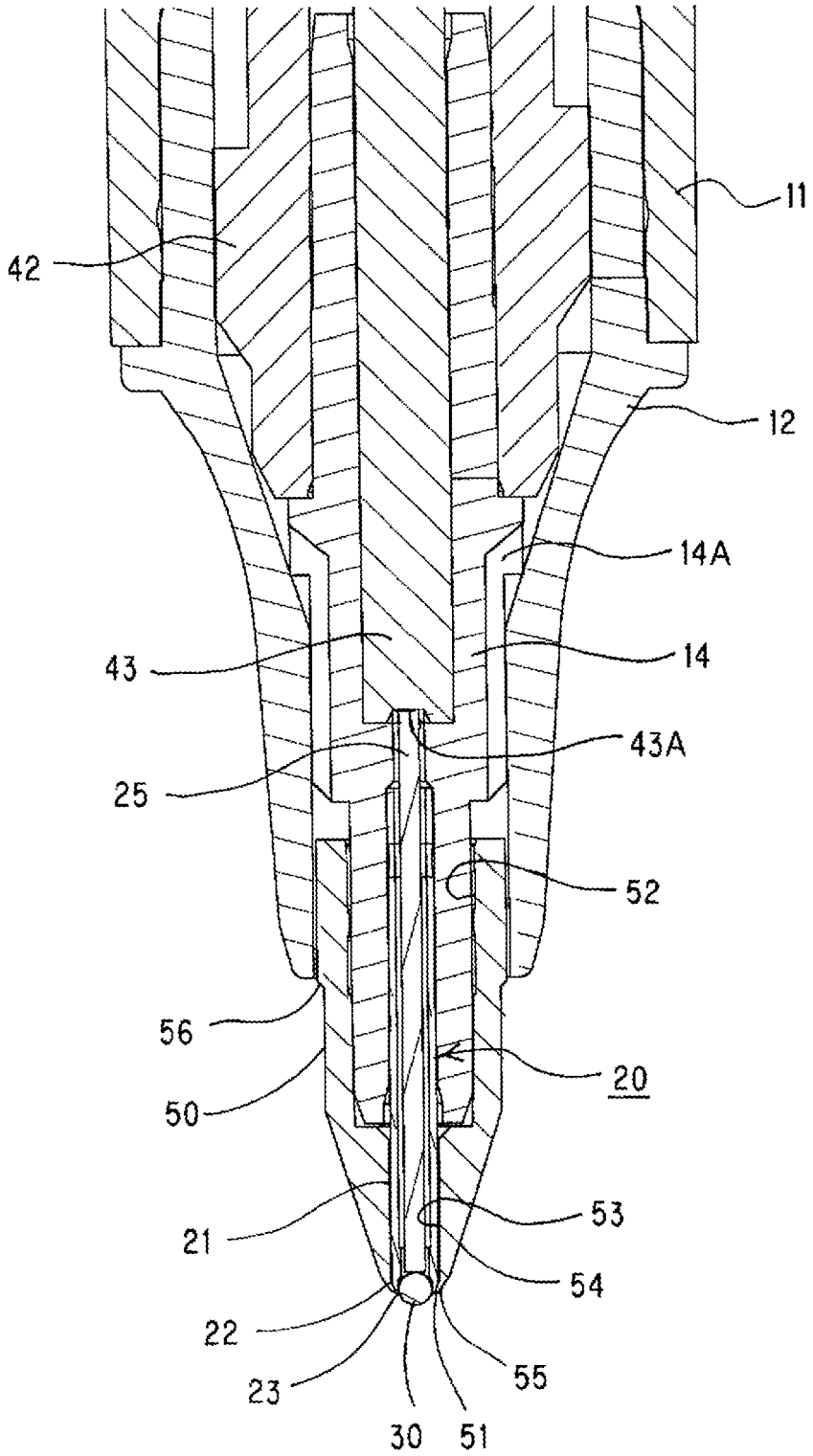
FIG. 9 is a vertical cross-sectional view of a tip portion of the ballpoint pen according to the second embodiment.

In the present embodiment, as illustrated in FIG. 9, the central core 25 is separated by a very small distance from a bottom surface of a recess portion 43A formed in the tip end surface of the collector core 43. Moreover, a vertical groove 14A in a radial shape in a cross-sectional view, extending in the axial direction is formed in a portion of the joint 14 protruding from the tip holding portion 42.

Figure 10:
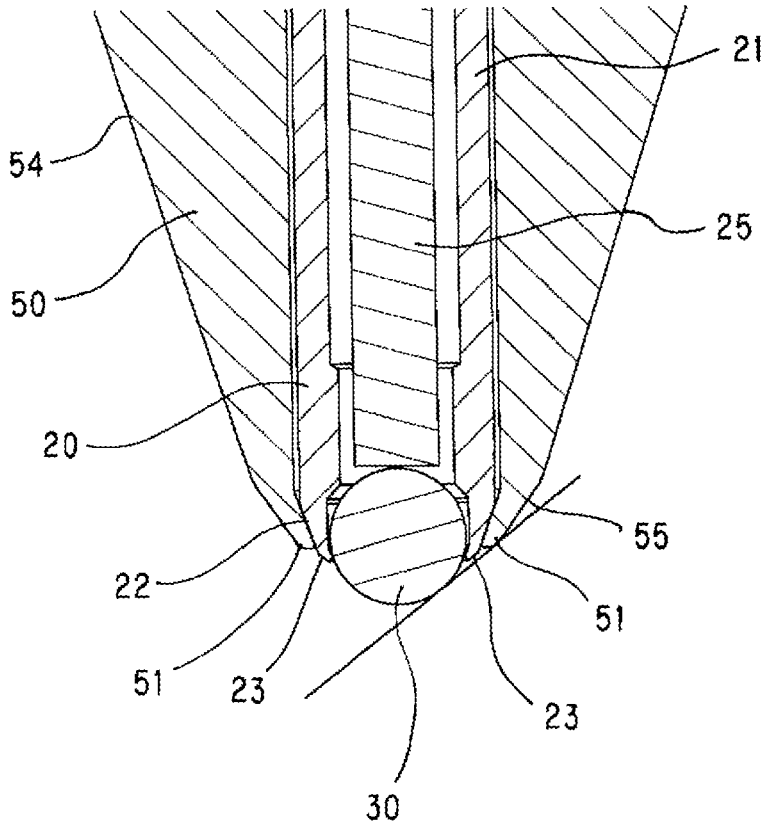
FIG. 10 is a vertical cross-sectional view of a writing tip of the ballpoint pen according to the second embodiment.

Furthermore, as illustrated in FIG. 9, the outer member 50 of the present embodiment has an end portion 56 which is formed by narrowing the diameter thereof and which is disposed at substantially the same position as the tip end portion of the front shaft portion 12 or slightly close to the tip end side. Moreover, as illustrated in FIG. 10, a chamfered portion 55 that is tapered toward the tip end is formed in the tip end portion of the tapered portion 54 of the outer member 50, and a round-chamfered outer member tip end portion 51 that makes contact with the writing surface simultaneously with the writing ball 30 is formed in a tip end portion of the chamfered portion 55. Further, the outer member tip end portion 51 may be taper-chamfered so as to have an inclined surface rather than being round-chamfered.

Figure 11A:
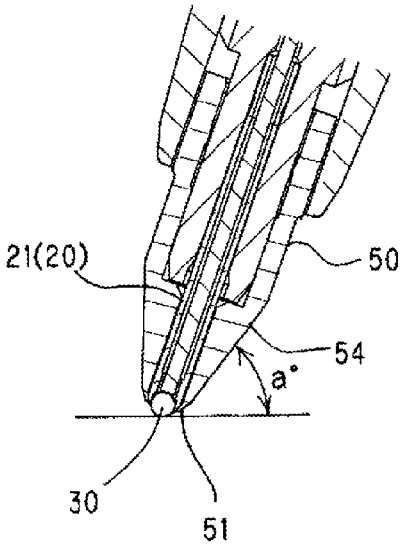
Figure 11B:
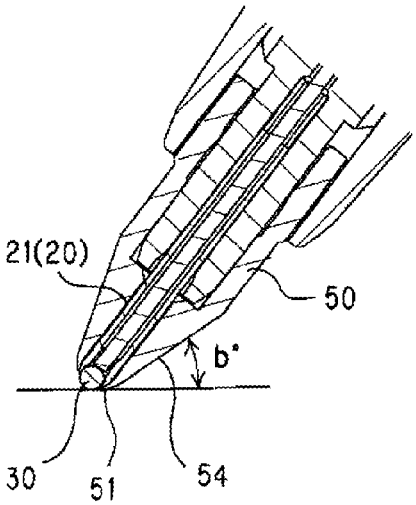
Figure 12:
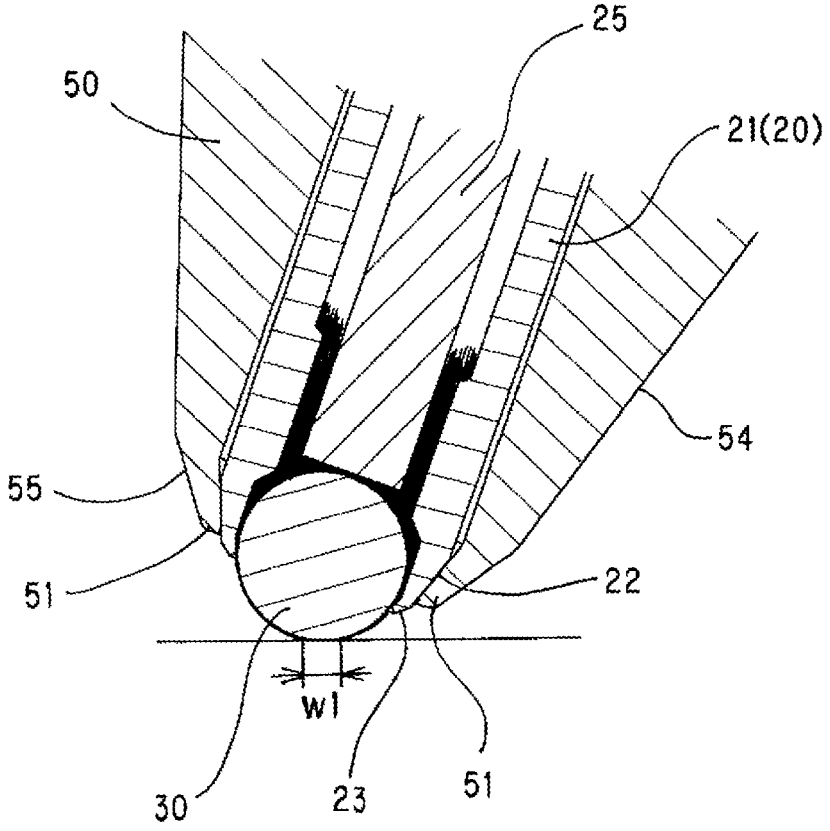
FIG. 12 is an enlarged view of a portion of FIG. 11A.
Figure 13:
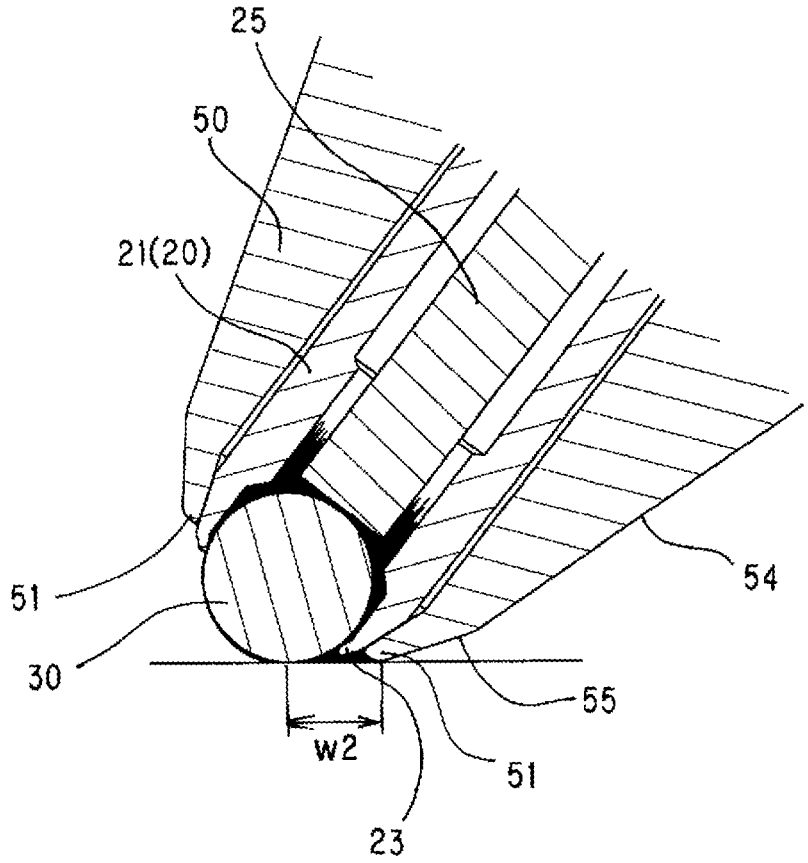
FIG. 13 is an enlarged view of a portion of FIG. 11B.

The ballpoint pen 1 according to the second embodiment provides the same advantageous effects as the first embodiment. That is, when the ballpoint pen 1 is so inclined that an angle of the tapered portion 54 of the outer member 50 in relation to the writing surface is a° as illustrated in FIG. 11A, it is possible to allow the writing ball 30 only to make contact with the writing surface as illustrated in FIG. 12 to draw a line having the width w1. Moreover, when the ballpoint pen 1 is so inclined that the angle of the tapered portion 54 of the outer member 50 in relation to the writing surface is b° smaller than a° as illustrated in FIG. 11B, it is possible to allow the writing ball 30 and the outer member tip end portion 51 to make contact with the writing surface simultaneously as illustrated in FIG. 13 to draw a line having the width w2 wider than the width w1 (see FIGS. 11A and 11B to FIG. 13).

(Third Embodiment)

FIGS. 14A and 14B to FIG. 16 illustrate the third embodiment of the present invention. Further, in the third embodiment, the same constituent components as those of the second embodiment will be denoted by the same reference numerals as those used in the second embodiment (The same goes for the fourth and fifth embodiments). Hereinafter, redundant description of portions overlapping those of the first and second embodiments will not be provided, and features of the present embodiment will be described.

Figure 14A:
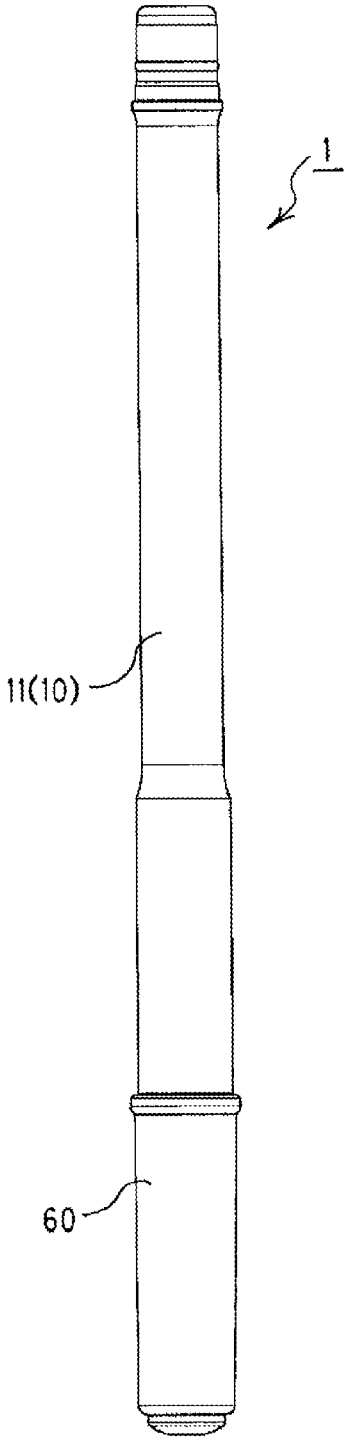
FIGS. 14A and 14B are a front view and a vertical cross-sectional view of a ballpoint pen according to a third embodiment of the present invention, respectively.
Figure 14B:
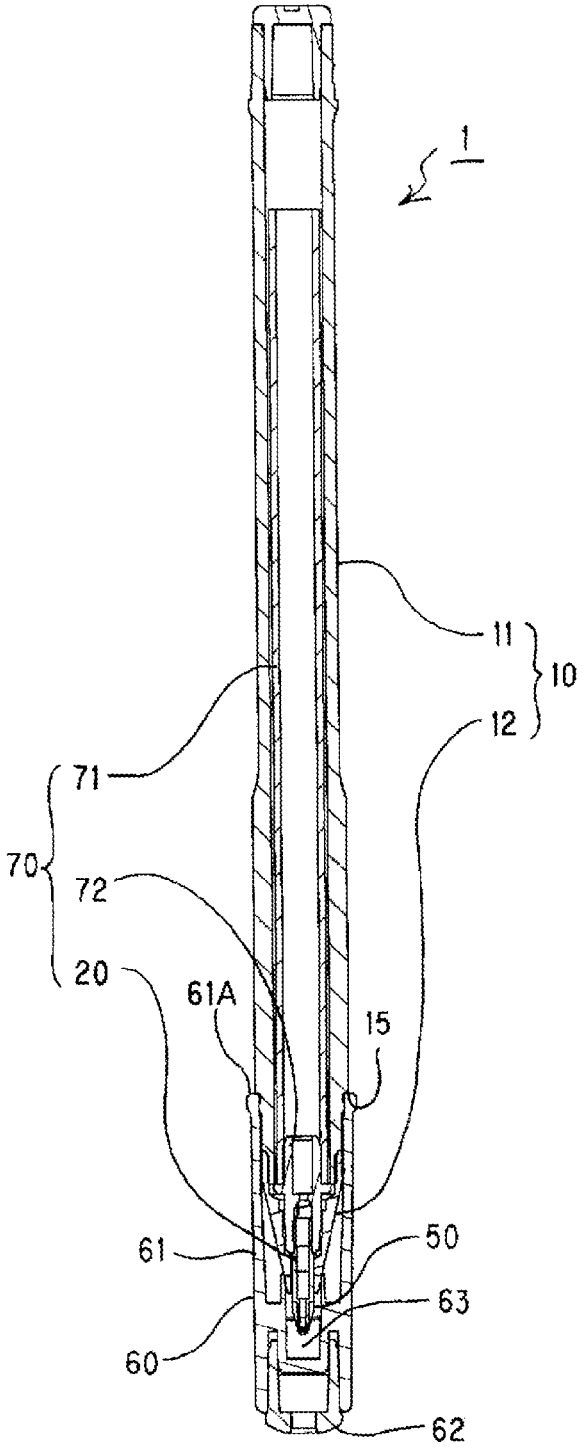

As illustrated in FIGS. 14A and 14B, the ballpoint pen 1 according to the third embodiment has an ink refill 70 to which the pen tip 20 is fixed and which is stored in the shaft tube 10 and a cap 60 for protecting the tip end portion of the pen tip 20.

Figure 16:
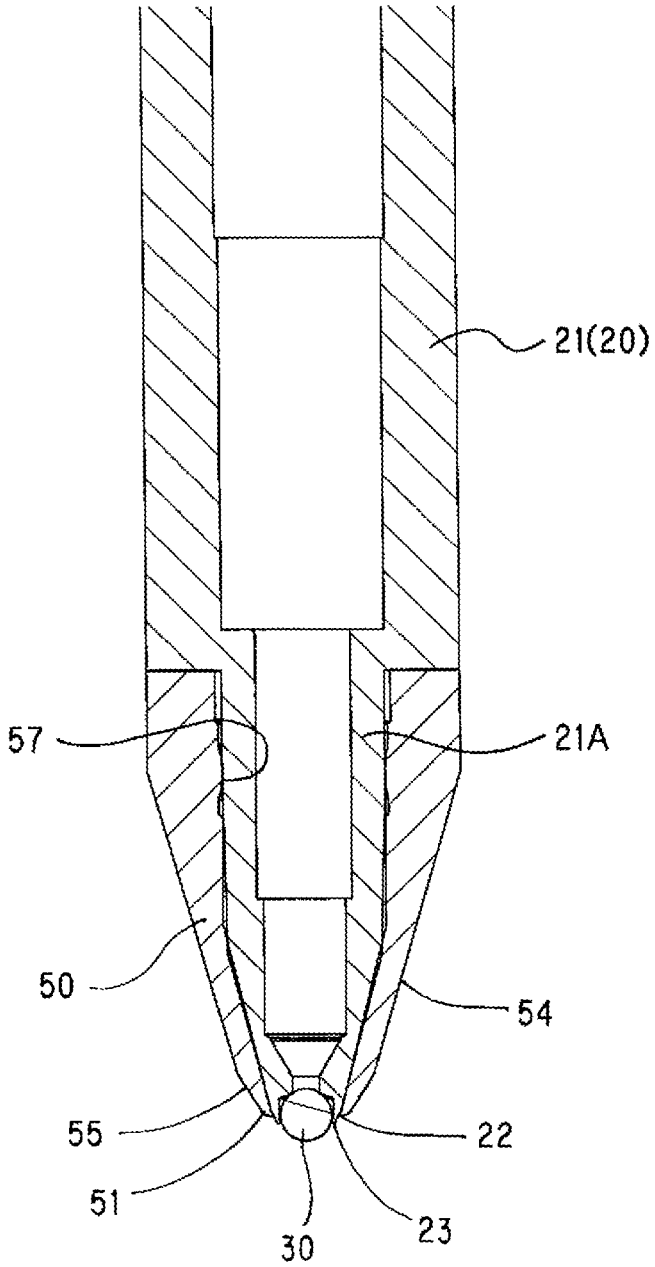
FIG. 16 is a vertical cross-sectional view of a tip portion of the ink refill according to the third embodiment.

As illustrated in FIG. 16, the pen tip 20 of the present embodiment has a small-diameter portion 21A formed in a tip end portion of the cylindrical holder 21 and a tapered portion 22 and a narrowed portion 23 which are provided in the tip end of the small-diameter portion 21A and in which the writing ball 30 is held. The holder 21 is hollow.

As illustrated in FIG. 14A, the cap 60 covers a portion close to the tip end side of the shaft tube 10 corresponding to an approximately ¼ of the entire length. As illustrated in FIG. 14B, the cap 60 includes a tube 61 made from a synthetic resin and a lid member 62 that is fitted from the tip end side of the tube 61, and a pen tip receiving portion 63 is provided in the cap 60. When the cap 60 covers the tip end portion of the shaft tube 10, a rear end portion 61A of the tube 61 is locked at a step 15 formed by narrowing the diameter of the shaft body 11 and the tip end portion of the pen tip 20 is positioned in the pen tip receiving portion 63.

Figure 15A:
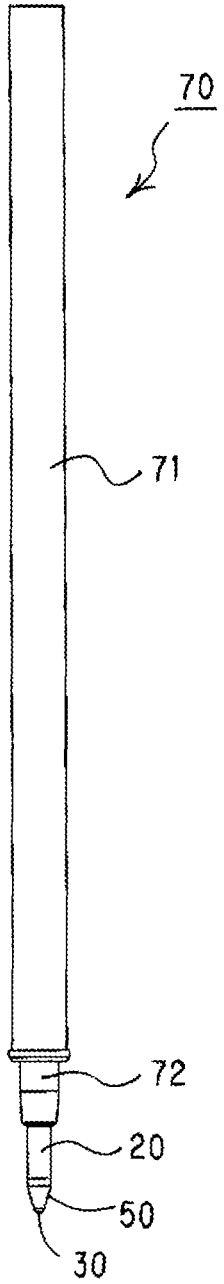
FIGS. 15A and 15B are a front view and a vertical cross-sectional view of an ink refill according to the third embodiment, respectively.
Figure 15B:
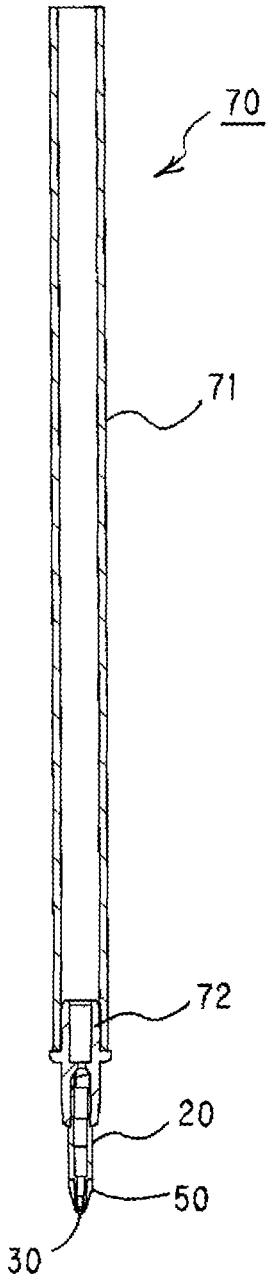

As illustrated in FIGS. 15A and 15B, the ink refill 70 includes an ink storage tube 71 in which ink is filled, a joint 72 fixed to the tip end of the ink storage tube 71, and a pen tip 20 fixed to the joint 72. The ink storage tube 71 is a polypropylene tube in which ink (not illustrated) and an ink following body for preventing ink leakage are filled. The joint 72 is a tubular member which has an opening that extends in a front-to-rear direction and of which the rear portion is press-fitted into the ink storage tube 71. The pen tip 20 is press-fitted into the front opening of the joint 72 exposed from the ink storage tube 71, and the ink in the ink storage tube 71 is supplied to the pen tip 20 from the rear opening. As illustrated in FIG. 14B, the ink refill 70 has the ink storage tube 71 stored in the shaft body 11, and the joint 71 and the pen tip 20 exposed from the joint 71 are covered by the front shaft portion 12.

In the present embodiment, as illustrated in FIG. 16, the outer member 50 has an insertion opening 57 in which the small-diameter portion 21A of the holder 21 is inserted from the rear side. The outer member 50 is fixed to the tip end portion of the holder 21 to cover the holder 21 in a state where the small-diameter portion 21A of the holder 21 is inserted in the insertion opening 57. Further, when the ink refill 70 is stored in the shaft tube 10, the outer member 50 is exposed from the tip end of the front shaft portion 12 as illustrated in FIG. 14B.

The ballpoint pen 1 according to the third embodiment provides the same advantageous effects as the first embodiment. Further, in the present embodiment, unlike the first and second embodiments, when ink in the ink refill 70 is used up and it is not possible to write, a user can replace the ink refill 70 and write again.

(Fourth Embodiment)

Figure 17A:
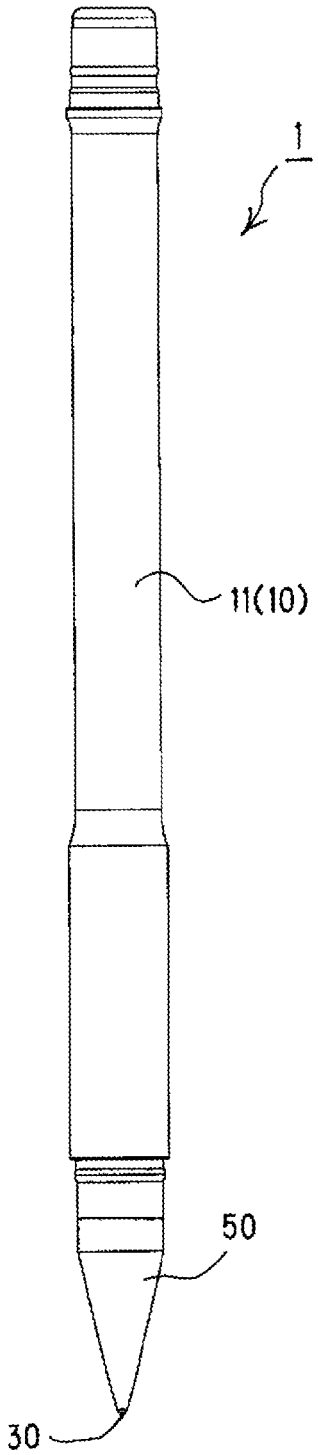
FIGS. 17A and 17B are a front view and a vertical cross-sectional view of a ballpoint pen according to a fourth embodiment of the present invention, respectively.
Figure 17B:
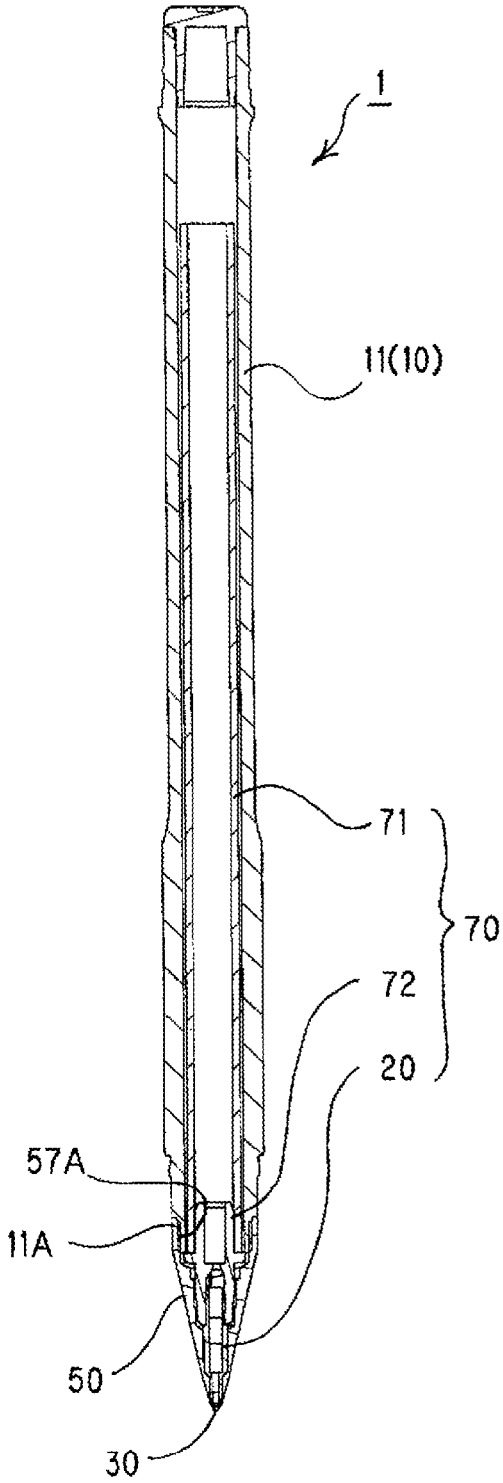
Figure 18:
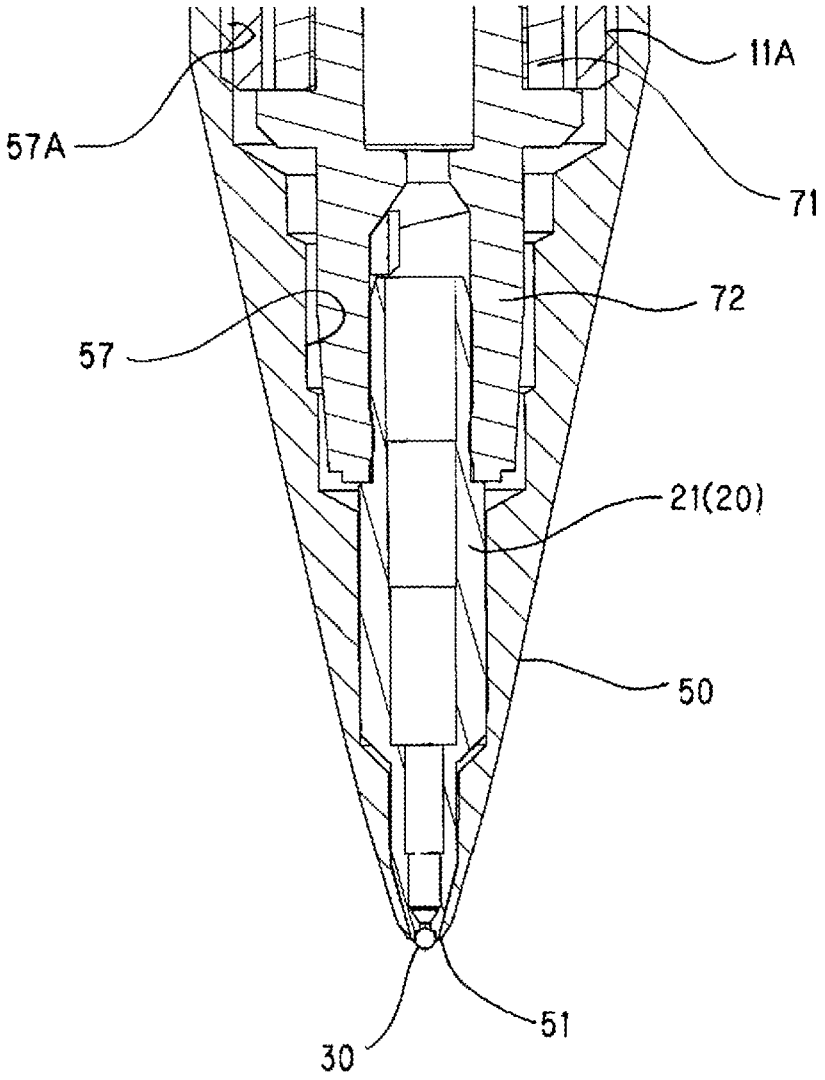
FIG. 18 is a vertical cross-sectional view of a tip portion of the ballpoint pen according to the fourth embodiment.

FIGS. 17A and 17B and FIG. 18 illustrate the fourth embodiment of the present invention. Hereinafter, redundant description of portions overlapping those of the first to third embodiments will not be provided, and features of the present embodiment will be described.

As illustrated in FIGS. 17A and 17B, the ballpoint pen 1 according to the fourth embodiment has an ink refill 70 to which the pen tip 20 is fixed and which is stored in the shaft tube 10. Although not illustrated in the drawings, the ballpoint pen 1 may include a cap for protecting the tip end portion of the pen tip 20.

Further, in the present embodiment, an approximately conical outer member 50 formed so as to be tapered toward the tip end is attached to the tip end portion of the shaft tube 10. An insertion hole 57 that passes from the rear side to the tip end side is formed in the outer member 50, and a screw portion 57A is formed on an inner circumferential surface on the rear side of the insertion hole 57 as illustrated in FIG. 17B and FIG. 18. Further, a screw portion 11A formed on the outer circumference on the tip end side of the shaft body 11 engages with the screw portion 57A to fix the outer member 50 and cover the joint 71 and the pen tip 20 exposed from the joint 71. That is, in the present embodiment, the outer member 50 also serves as a front shaft portion.

According to the fourth embodiment, it is possible to provide the same advantageous effects as the above-described embodiments and to reduce the number of components and simplify product assembly steps.

(Fifth Embodiment)

Figure 19A:
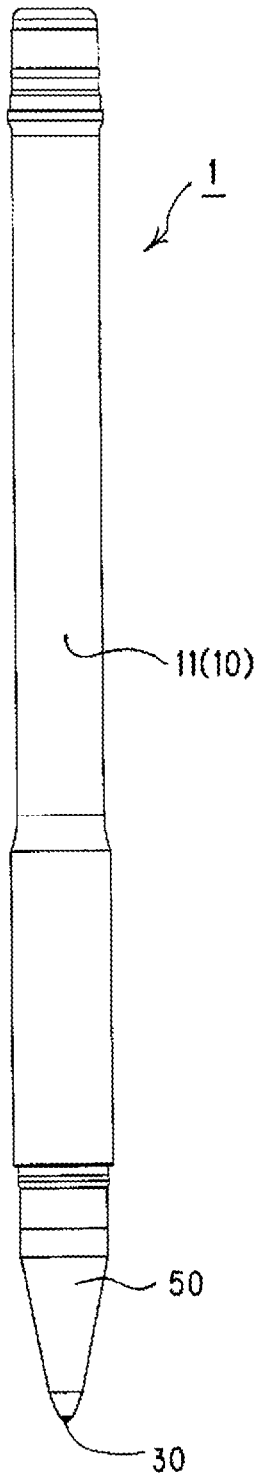
FIGS. 19A and 19B are a front view and a vertical cross-sectional view of a ballpoint pen according to a fifth embodiment of the present invention, respectively.
Figure 19B:
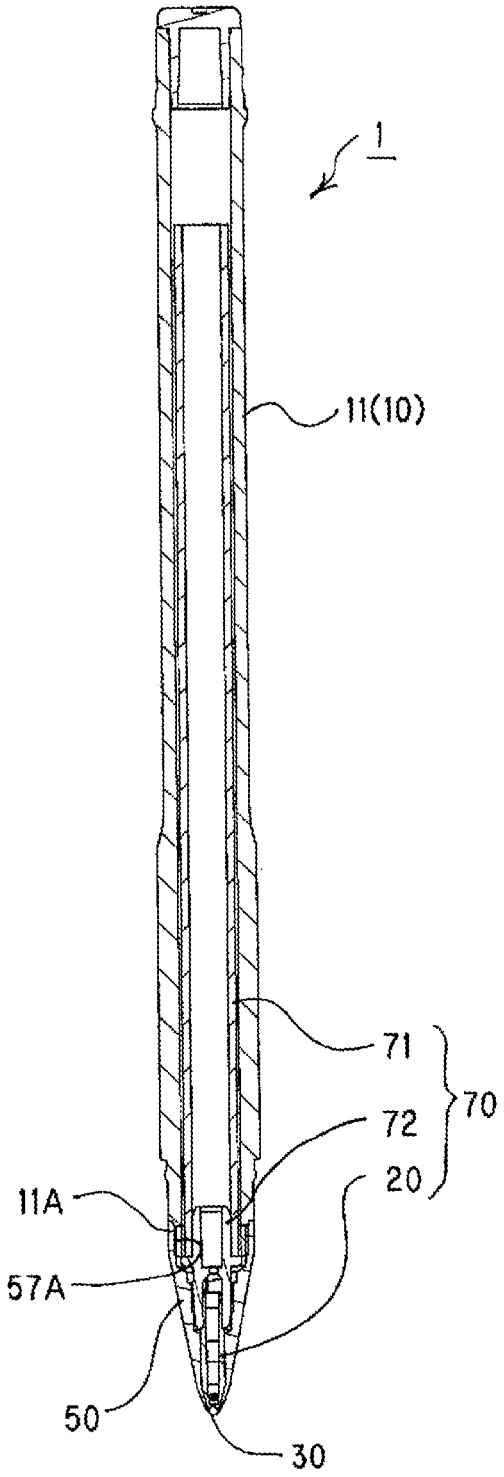
Figure 20:
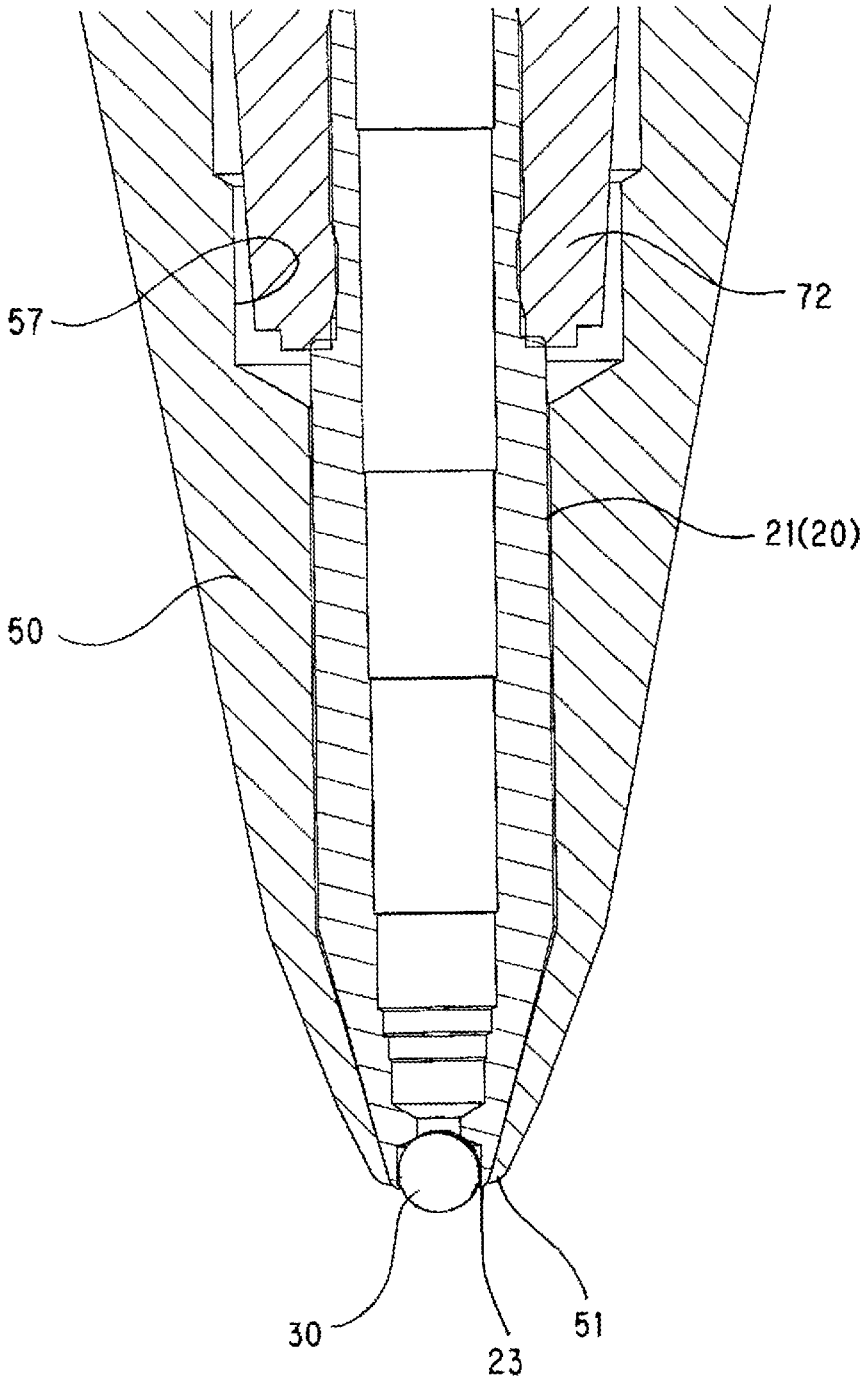
FIG. 20 is a vertical cross-sectional view of a tip portion of the ballpoint pen according to the fifth embodiment.

FIGS. 19A and 19B and FIG. 20 illustrate the fifth embodiment of the present invention. A ballpoint pen 1 according to the present embodiment has a writing ball 30 having a larger diameter than the writing ball 30 of the fourth embodiment. The other configuration is the same as that of the fourth embodiment except that, since the diameter of the tip end portion of the pen tip 20 is larger than that of the fourth embodiment, the taper angle of the outer member 50 is gentle and a tapered portion having a different angle is provided in the tip end portion of the outer member 50.

(Sixth Embodiment)

FIGS. 21 to 26 illustrate the sixth embodiment of the present invention.

Figure 21A:
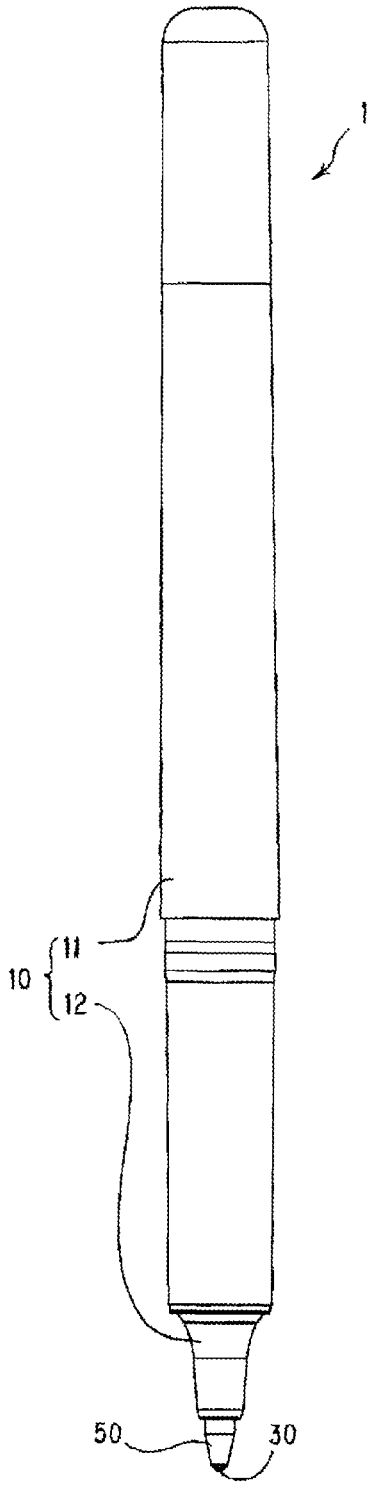
FIGS. 21A and 21B are a front view and a vertical cross-sectional view of a ballpoint pen according to a sixth embodiment of the present invention, respectively.
Figure 21B:
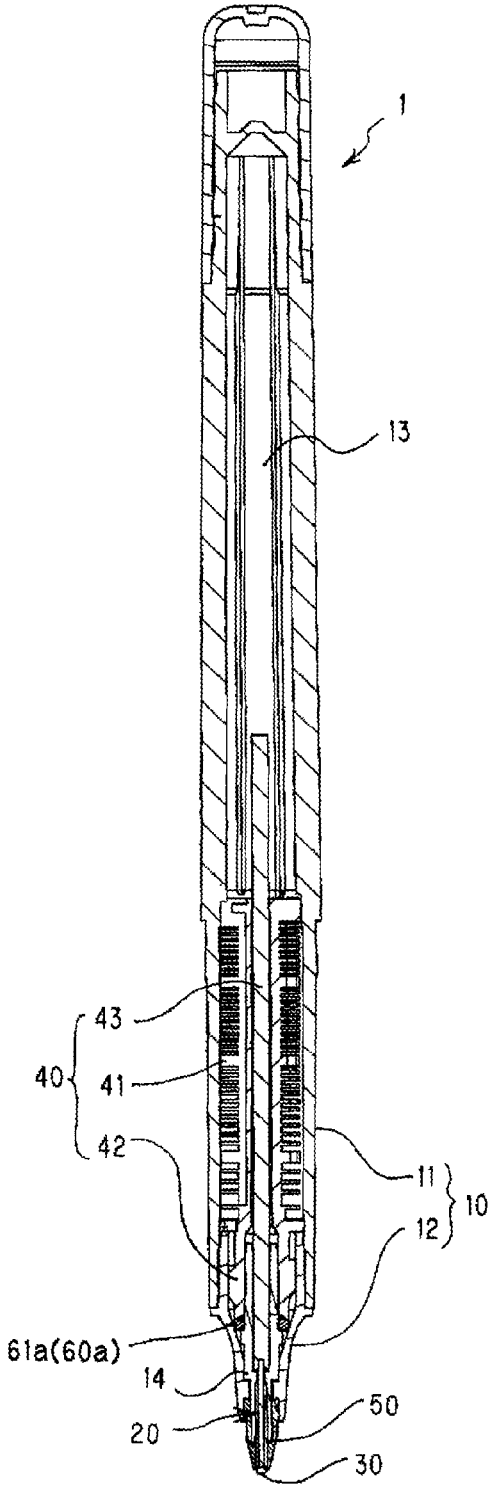

As illustrated in FIGS. 21A and 21B, the ballpoint pen 1 according to the present embodiment includes a pen tip 20 that has a writing ball 30 and a holder 21 which is a first writing portion that holds the writing ball 30 using a narrowed portion 23 (see FIGS. 24 and 25) that has a narrowed tip end, an ink supply portion 40 that supplies ink to the holder 21 of the pen tip 20, a shaft tube 10 that stores the ink supply portion 40 therein, an outer member 50 which is a second writing portion that covers an outer circumference of the holder 21, and a displacement means 60*a* for changing a relative position in the axial direction of the outer member 50 and the holder 21. Moreover, although not illustrated in the drawing, a cap which can be detachably attached to the tip end and the rear end of the shaft tube 10 is also provided.

As illustrated in FIG. 21B, the shaft tube 10 includes a shaft body 11 having an ink storage portion 13 and a front shaft portion 12 provided at a tip end of the shaft body 11, and the ink supply portion 40 and a joint 14 that connects the ink supply portion 40 and the pen tip 20 are included on a tip end side of the shaft body 11. Ink (not illustrated) is filled in the ink storage portion 13.

The ink supply portion 40 has an approximately tubular collector 41 in which a plurality of fins is formed on an outer circumference thereof and a tip holding portion 42 formed by narrowing a tip end of the collector 41. A rear end portion of the collector 41 is in contact with the ink storage portion 13, and the tip holding portion 42 is fitted into the front shaft portion 12. Moreover, a rear end portion of the joint 14 is fitted into the tip holding portion 42. Moreover, a rod-shaped collector core 43 made from polyester fiber passes in an axial direction of the collector 41. A rear end of the collector core 43 protrudes into the ink storage portion 13, and a tip end portion of the collector core 43 protrudes further toward the tip end than the tip holding portion 42 and is fitted into the joint 14 from the rear end portion of the joint 14. Further, the joint 14 is so formed as to be slidable through the tip holding portion 42 in the axial direction integrally with the collector core 43.

Figure 22:
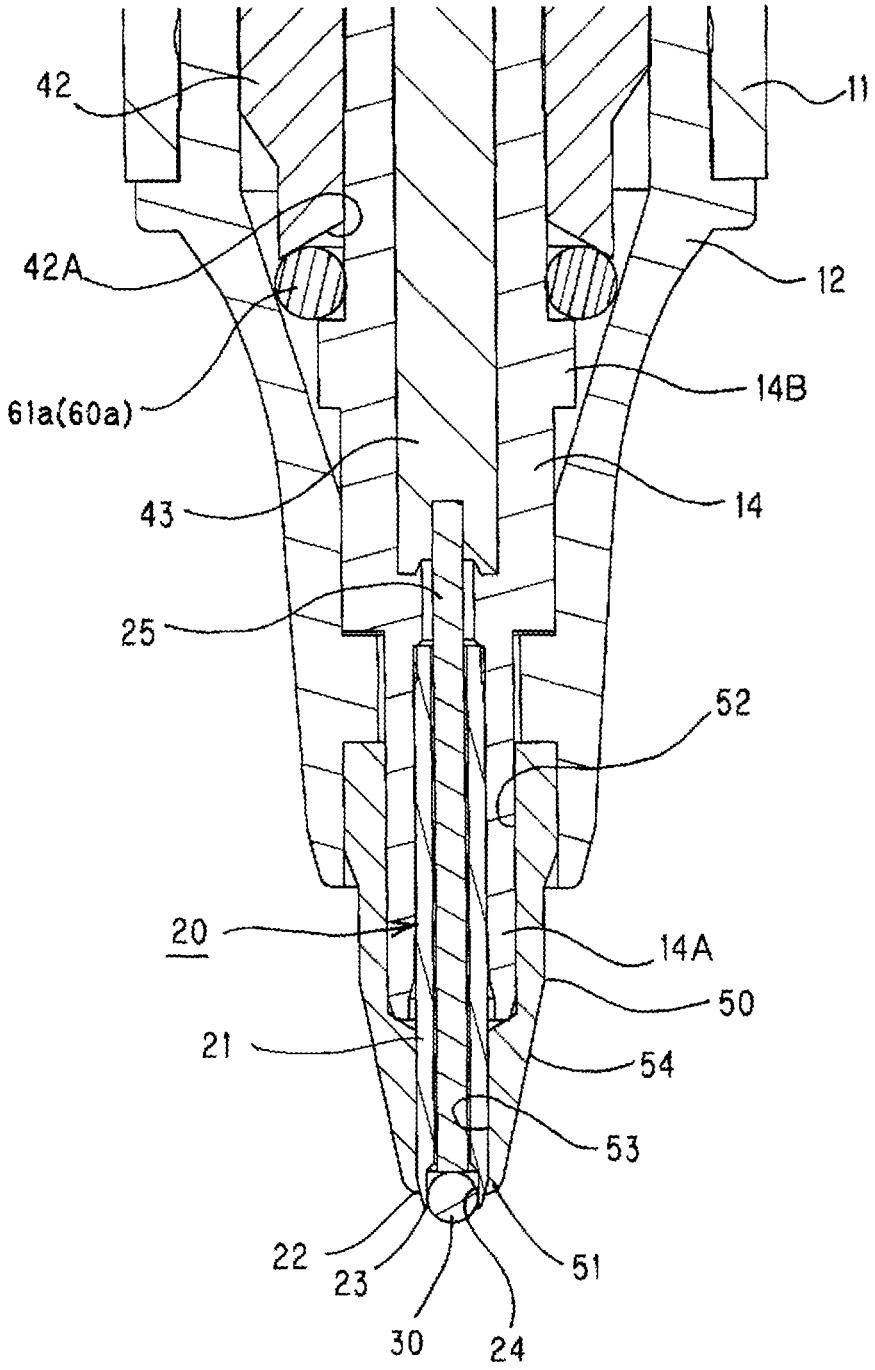
FIG. 22 is a vertical cross-sectional view of a tip portion of the ballpoint pen according to the sixth embodiment.

As illustrated in FIG. 22, the pen tip 20 includes the cylindrical holder 21 and the writing ball 30 held in the holder 21. An approximately conical tapered portion 22 which is narrowed toward the tip end is formed on a tip end side of the holder 21, and the narrowed portion 23 (see FIG. 24) deformed by pressing a small opening of the tapered portion 22 toward the inner side to reduce the diameter of the opening is formed on the tip end side. Further, a tip end portion of the writing ball 30 held in a ball house 24 that is formed in an inner side of the tapered portion 22 is exposed from a tip edge of the narrowed portion 23. The holder 21 can be formed by processing a pipe material made from metal such as stainless steel and a resin such as polyacetal. Moreover, a rod-shaped central core 25 that protrudes from the rear end portion of the holder 21 is inserted into the holder 21. The central core 25 is formed from polyester fiber similarly to the collector core 43 and has a rear end that is fitted into the tip end portion of the collector core 43 and a tip end that reaches the rear end of the writing ball 30. The central core 25 absorbs ink entering into the collector core 43 to supply ink to the ball house 24. As illustrated in FIG. 22, the pen tip 20 is held in the joint 14 in a state where a portion of the pen tip 20 corresponding to approximately ⅔ of the entire length from the rear end side is fitted into the tip end portion 14A of the joint 14.

Further, the collector core 43 and the central core 25 are formed by appropriately selecting the porosity and the surface shape of polyester fiber according to a property such as viscosity of ink used. Moreover, in the present embodiment, although ink is stored in the shaft tube 10 and the ink supply portion 40 supplies ink to the pen tip 20, an ink refill formed by press-fitting the pen tip 20 into the tip end of an ink storage tube that stores ink and ink core may be provided in the shaft tube 10.

The outer member 50 is an approximately conical tube made from a synthetic resin, and as illustrated in FIG. 22, has a tapered portion 54 that is tapered toward the tip end. A round-chamfered outer member tip end portion 51 is formed in a tip end portion of the tapered portion 54. Further, the outer member tip end portion 51 may be taper-chamfered so as to have an inclined surface rather than being round-chamfered. Moreover, the outer member 50 has a rear insertion hole 52 formed on the rear side and a front insertion hole 53 that passes from the rear insertion hole 52 to the tip end side and has a smaller diameter than the rear insertion hole 52. The tip end portion 14A of the joint 14 is inserted into the rear insertion hole 52, and the holder 21 of the pen tip 20 exposed from the joint 14 is inserted into the front insertion hole 53. Further, the tip end portion 14A of the joint 14 is configured to be slidable through the rear insertion hole 52 in the axial direction, and the holder 21 is configured to be slidable through the front insertion hole 53 in the axial direction.

Figure 23A:
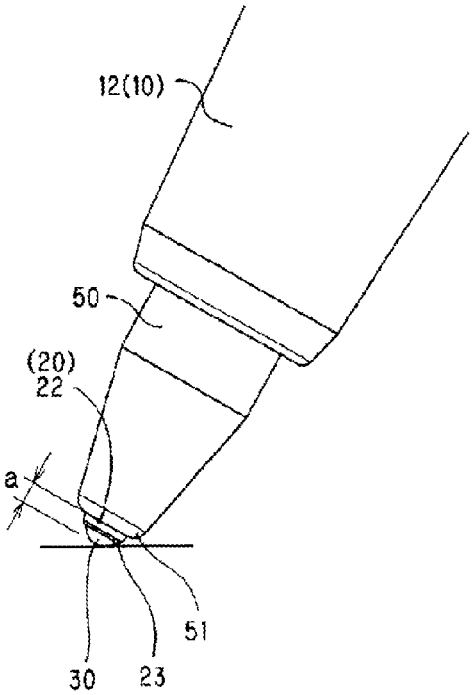

Further, the outer member 50 is inserted from the tip end side of the holder 21 and the joint 14 protruding from the tip end of the front shaft portion 12 and is fixed to the front shaft portion 12. In a state where the outer member 50 is fixed to the front shaft portion 12, the holder 21 is inserted into the front insertion hole 53 and the tip end portion 14A of the joint 14 is inserted into the rear insertion hole 52. Moreover, in this state, as illustrated in FIG. 23A, a portion of the outer member tip end portion 51 closest to the tip end side is positioned closer to the rear side than the narrowed portion 23 of the holder 21, and the outer member 50, the tapered portion 22 and the narrowed portion 23 of the holder 21, and the writing ball 30 are exposed from the tip end of the front shaft portion 12. Such a positional relation of the outer member 50 and the holder 21 is referred to as a holder protruding position as a protruding position of the first writing portion. In the present embodiment, the holder protruding position is the initial position of the ballpoint pen 1.

As illustrated in FIG. 22, the displacement means 60*a* is an elastic member disposed in the tip end of the tip holding portion 42 of the ink supply portion 40. In the present embodiment, the elastic member is an O-shaped ring 61*a* made from a silicon resin. When the joint 14 is fitted into the tip holding portion 42 in a state where the O-shaped ring 61*a* is fitted from the rear end portion of the joint 14, the O-shaped ring 61*a* is sandwiched between a receiving portion 42A that is formed in the tip end of the tip holding portion 42 so as to be recess portioned in a conical form and a flange portion 14B formed around the joint 14.

Further, the O-shaped ring 61*a* is compressed and deformed by receiving load in the axial direction, and a relative position in the axial direction of the outer member 50 and the holder 21 changes with positional movement of the joint 14 and the pen tip 20 held in the joint 14. Specifically, when load is applied from the tip end of the writing ball 30, force acts on the joint 14 toward the rear side, the O-shaped ring 61*a* is pressed against the flange portion 14B and crushed against the receiving portion 42A. In this way, the joint 14 and the pen tip 20 move toward the rear side in relation to the outer member 50, the front shaft portion 12, and the tip holding portion 42. Further, when the joint 14 and the pen tip 20 reach the rearmost side, a portion of the outer member tip end portion 51 closest to the tip end is positioned up to a position slightly exceeding the boundary line between the narrowed portion 23 and the tapered portion 22 of the holder 21. Due to this, a portion of the outer member 50 corresponding to approximately ⅔ of the entire length close to the tip end side, the narrowed portion 23 of the holder 21, and a portion of the writing ball 30 are exposed from the tip end of the front shaft portion 12. Such a positional relation of the outer member 50 and the holder 21 is referred to as a holder retracting position as a retracting position of the first writing portion. Further, when the load applied to the writing ball 30 disappears, the O-shaped ring 61*a* is elastically deformed to restore an original shape and the joint 14 and the pen tip 20 move to the holder protruding position to return to the initial state.

Figure 24:
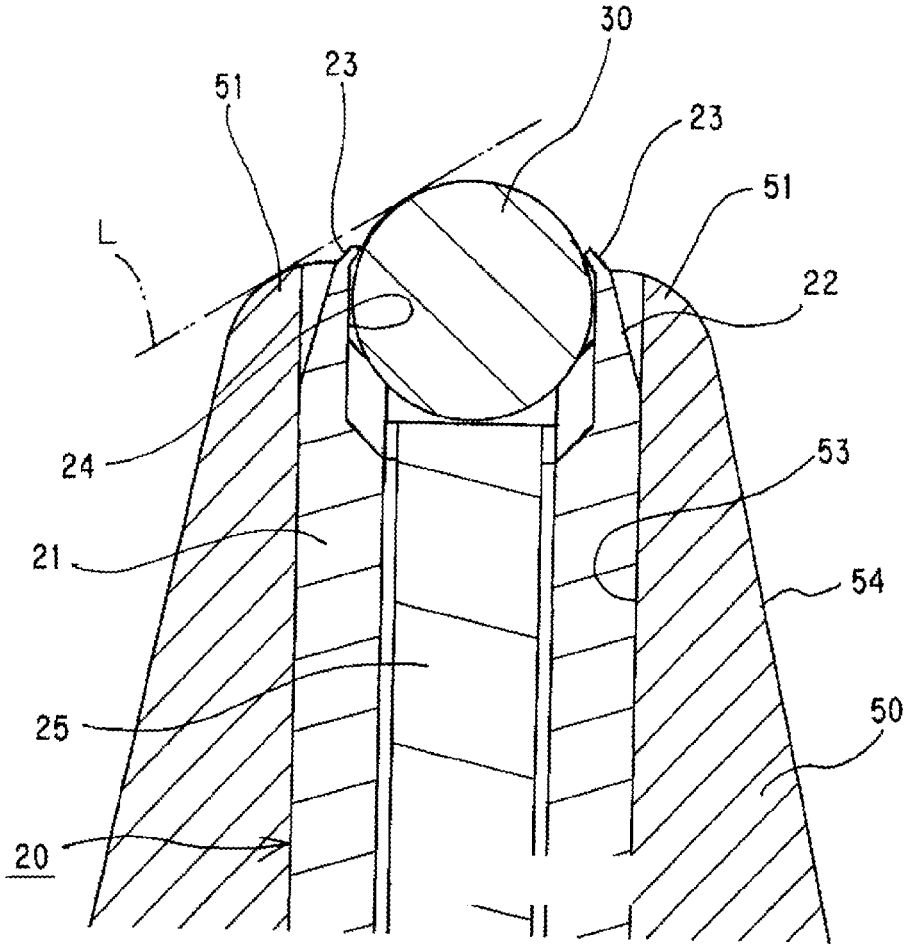
FIG. 24 is an enlarged vertical cross-sectional view of a writing tip in a holder retracting state.

Here, in the holder retracting position, as illustrated in FIG. 24, the narrowed portion 23 is positioned on the inner side (close to the writing ball 30) than a tangent L that touches both the outer member tip end portion 51 and the writing ball 30. That is, the outer member tip end portion 51 is formed in such a shape as to swell from the outer surface of the narrowed portion 23 so that the outer member tip end portion 51, the writing ball 30, and the narrowed portion 23 are in the above-described positional relation in the holder retracting position. Due to this, when the writing ball 30 and the outer member tip end portion 51 come into contact with a writing surface simultaneously, ink adhering to the surface of the writing ball 30 and ink leaking from the ball house 24 with rotation of the writing ball 30 diffuse into a space portion between a contact portion of the writing ball 30 and the writing surface and a contact portion of the outer member tip end portion 51 and the writing surface according to capillary phenomenon. Thus, it is possible to draw bolder lines as compared to when the writing ball 30 and the outer member tip end portion 51 do not come into contact with the writing surface simultaneously.

In the present embodiment, relatively low-viscosity ink capable of diffusing between the contact portion of the writing ball 30 and the writing surface and the contact portion of the outer member tip end portion 51 and the writing surface in a state where the writing ball 30 and the outer member tip end portion 51 are in contact with the writing surface simultaneously is used. The use of such ink prevents blurring even when bold lines are drawn.

A method of using the ballpoint pen 1 having the above-described configuration will be described based on FIGS. 23A and 23B, FIG. 25, and FIG. 26.

Figure 25:
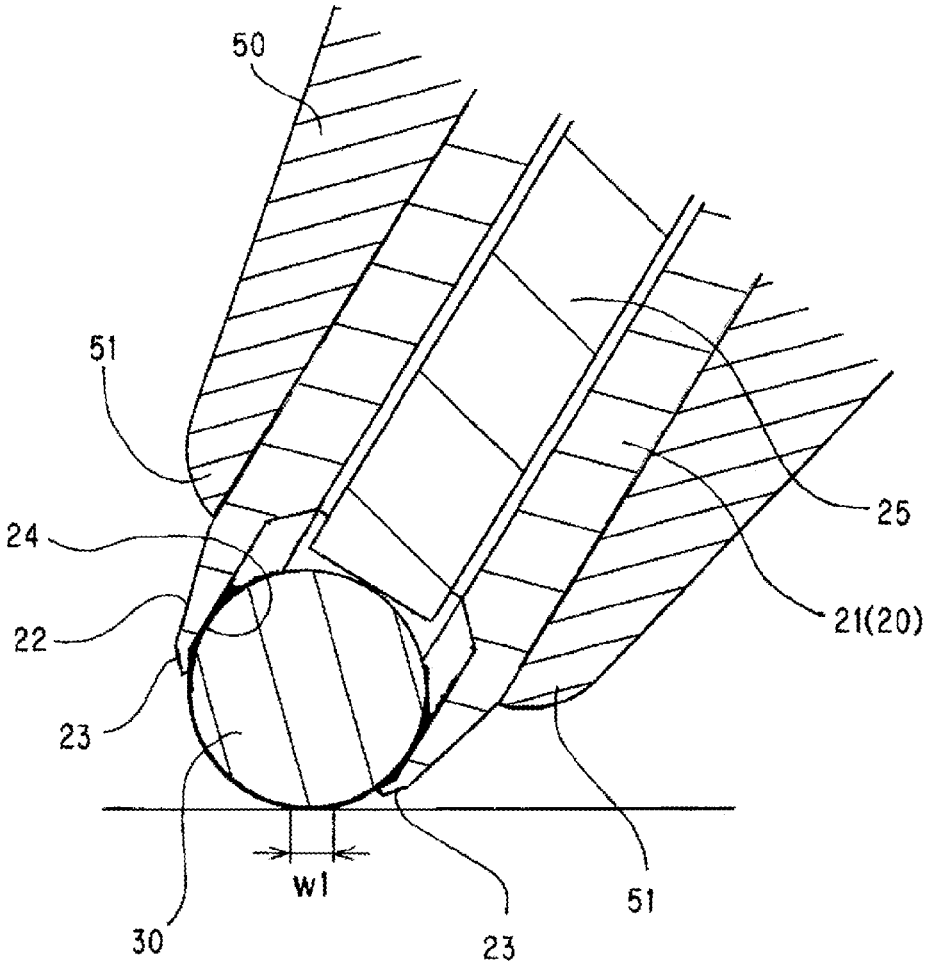
FIG. 25 is an enlarged vertical cross-sectional view of the writing tip of FIG. 23A.

As illustrated in FIG. 23A, when the outer member 50 and the pen tip 20 are at the initial position (that is, when the positional relation of the outer member 50 and the pen tip 20 is at the holder protruding position), and the shaft tube 10 is inclined at a predetermined angle to allow the writing ball 30 to make contact with the writing surface, it is possible to allow the writing ball 30 only to make contact with the writing surface because the outer member tip end portion 51 is positioned closer to the rear side than the narrowed portion 23 and is positioned closer to the rear side than a tangent that touches both the writing ball 30 and the narrowed portion 23. In the holder protruding position, the length from the tip end of the outer member tip end portion 51 to the tip end of the writing ball 30 is "a." When a user writes lines in this state, it is possible to draw a line having the width w1 with the ink adhering to the surface of the writing ball 30 as illustrated in FIG. 25.

Figure 23B:
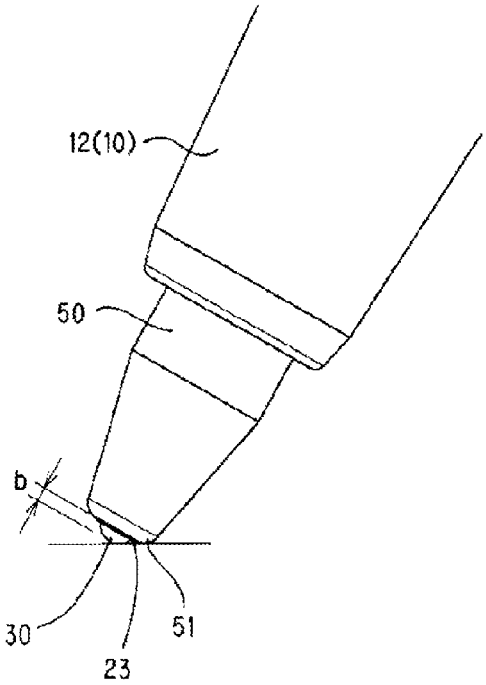
Figure 26:
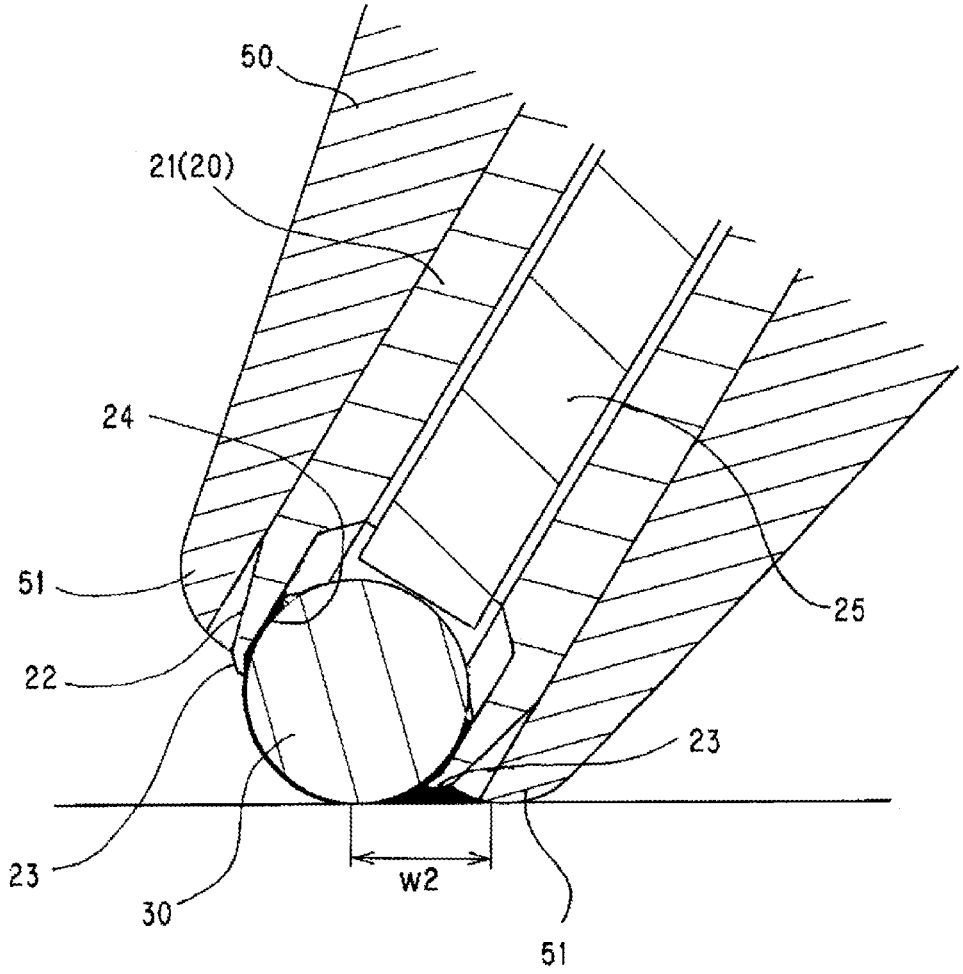
FIG. 26 is an enlarged vertical cross-sectional view of the writing tip of FIG. 23B.

On the other hand, when writing load is increased (the writing ball 30 is pressed against the writing surface) without changing the inclination angle of the shaft tube 10 in the state illustrated in FIG. 23A, load is applied to the holder 21 from the tip end and the pen tip 20 and the joint 14 are pushed toward the rear side and are positioned at the holder retracting position as illustrated in FIG. 23B. In this case, the length from the tip end of the outer member tip end portion 51 to the tip end of the writing ball 30 is "b" shorter than the length "a" at the holder protruding position, and the writing ball 30 and the outer member tip end portion 51 make contact with the writing surface simultaneously. In this state, ink adhering to the surface of the writing ball 30 diffuses into the writing surface according to capillary phenomenon and adheres to the outer member tip end portion 51, and ink remains in a space portion surrounded by the writing ball 30, the writing surface, the outer member tip end portion 51, and the narrowed portion 23 as illustrated in FIG. 26. Further, when a user writes lines in such a state, ink leaks into the space portion with rotation of the writing ball 30 and it is possible to draw a line having the width w2 wider than the width w1 with the ink diffusing between the contact portion of the writing ball 30 and the writing surface and the contact portion of the outer member tip end portion 51 and the writing surface according to capillary phenomenon. In this case, since the positional relation between the writing ball 30 and the narrowed portion 23 is maintained, it is possible to maintain the amount of ink leaking with rotation of the writing ball 30 to be constant and to prevent ink leakage.

Further, when the writing load is decreased in the state illustrated in FIG. 23B, the positional relation between the outer member 50 and the pen tip 20 return to the holder protruding position. Moreover, in the state illustrated in FIG. 23B, when a user puts the shaft tube 10 in a close-to-vertically standing state in relation to the writing surface, the writing ball 30 only makes contact with the writing surface. Thus, it is naturally not possible to draw bold lines.

As described above, the ballpoint pen 1 according to the sixth embodiment can change the width of drawn lines just by changing writing load during writing. That is, the writing load may be decreased so that the pen tip 20 does not retract when a user draws narrow lines, and the writing load may be increased so that the pen tip 20 retracts when a user draws bold lines. Further, in the present embodiment, since it is easy to change the width and the thickness of lines in the middle of writing by changing the width of drawn lines according to writing load, the ballpoint pen is ideally used for drawing and ballpoint pen-based calligraphy.

Moreover, by adjusting the shape (the amount of protrusion toward the front side or the lateral side) of the outer member tip end portion 51 of the outer member 50, it is possible to equalize the line width when the writing ball 30 and the outer member tip end portion 51 make contact with the writing surface simultaneously, even when the writing ball 30 has a different ball diameter.

Further, the elastic member is not limited to the O-shaped ring 61*a* but a spring may be used.

Moreover, in the above-described embodiment, although the joint 14 and the pen tip 20 are so formed as to move integrally, the pen tip 20 only may move.

(Seventh Embodiment)

FIGS. 27A and 27B to FIG. 31 illustrate the seventh embodiment of the present invention. Further, FIGS. 25 and 26 of the sixth embodiment are also applicable to the seventh embodiment. Moreover, in the seventh embodiment, the same constituent components as those of the sixth embodiment will be denoted by the same reference numerals as those used in the sixth embodiment. Hereinafter, redundant description of portions overlapping those of the sixth embodiment will not be provided, and features of the present embodiment will be described. The same goes for the eighth to fourteenth embodiments.

In the present embodiment, the outer member 50 is so formed as to be movable in the axial direction in relation to the pen tip 20 and includes a rotary feeding mechanism 62*a* that can move the outer member 50 between a holder protruding position and a holder retracting position as the displacement means 60*a*.

Figure 27A:
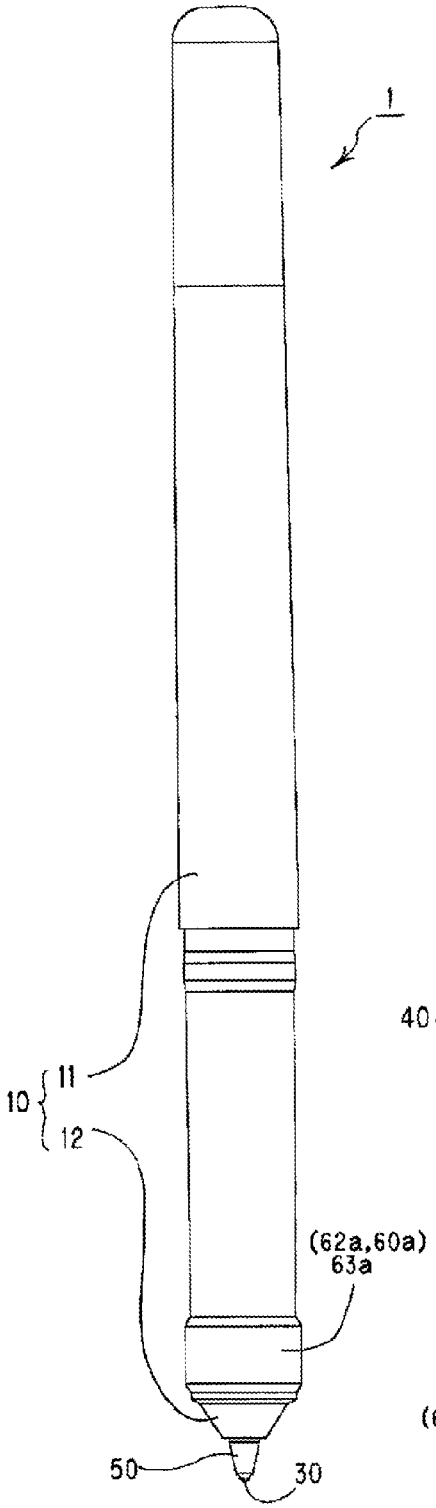
FIGS. 27A and 27B are a front view and a vertical cross-sectional view of a ballpoint pen according to a seventh embodiment of the present invention, respectively.
Figure 27B:
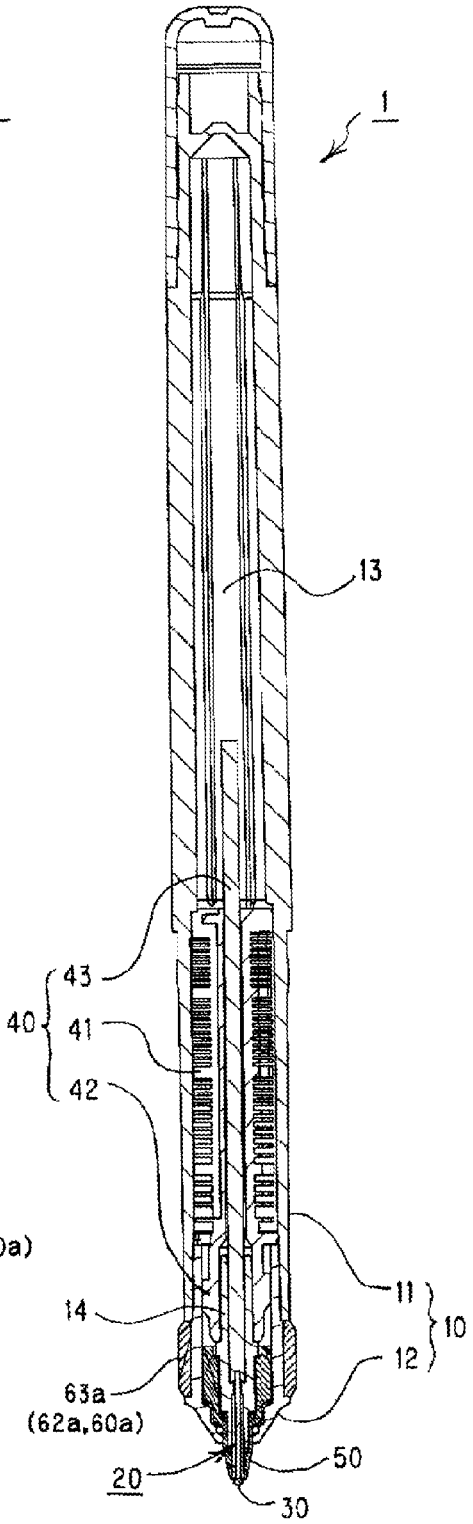

As illustrated in FIG. 27B, the outer member 50 of the present embodiment has a rear-side portion received in a shaft tip portion 12 and is so supported as to be slidable in an axial direction between the shaft tip portion 12 and the joint 14 that holds the pen tip 20.

Figure 28A:
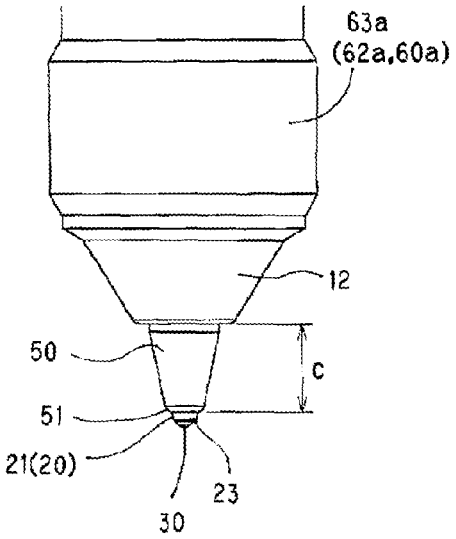
Figure 28B:
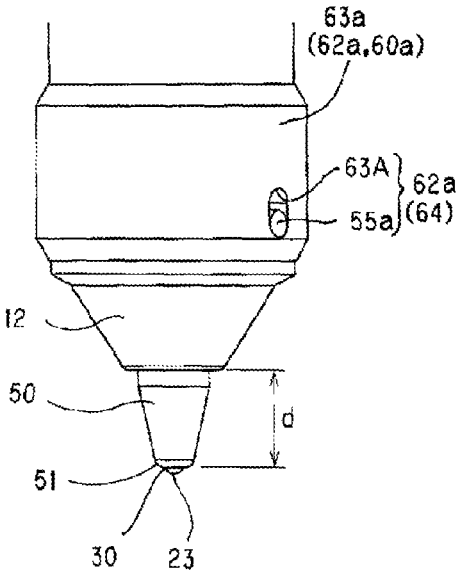
Figure 29:
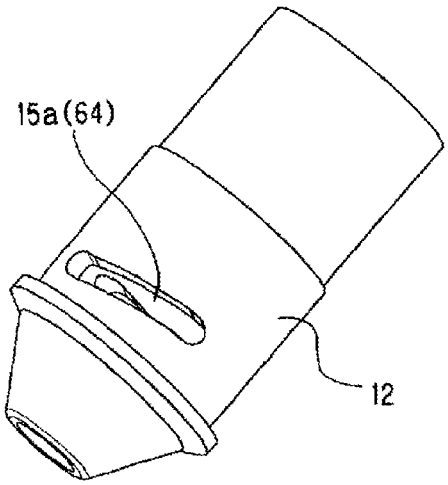
FIG. 29 is a perspective view of a front shaft portion according to the seventh embodiment.
Figure 30:
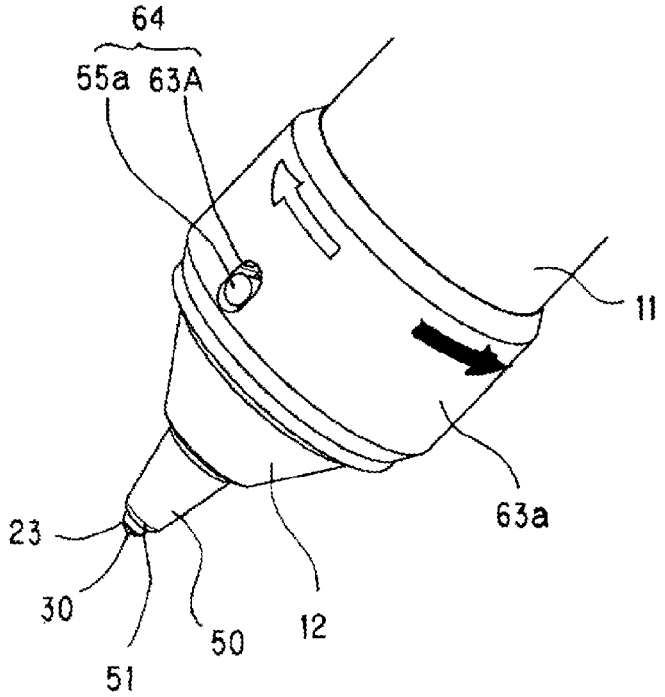
FIG. 30 is a perspective view of a writing portion according to the seventh embodiment.
Figure 31:
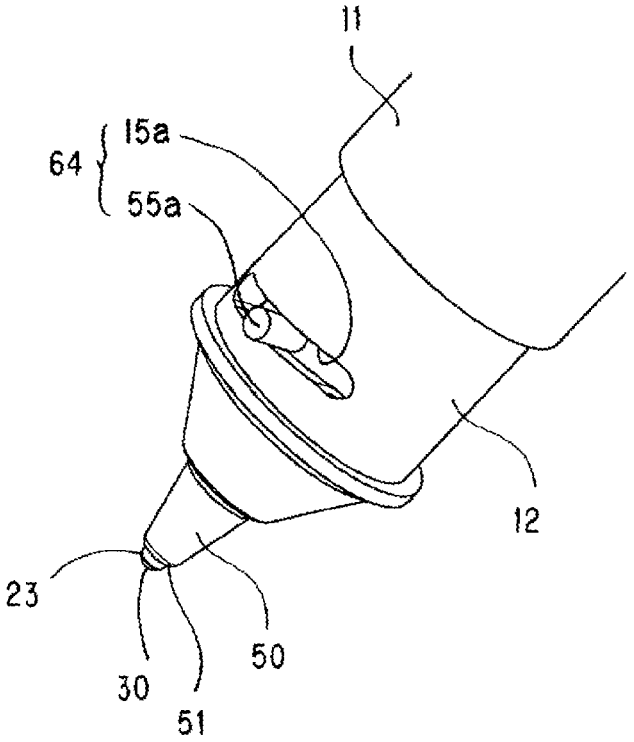
FIG. 31 is a perspective view of a writing portion in which a rotation operating portion is removed according to the seventh embodiment.

Moreover, as illustrated in FIGS. 27A and 27B and FIGS. 28A and 28B, the rotary feeding mechanism 62*a* includes a tubular rotation operating portion 63*a* positioned at the tip end side of the shaft body 11 so as to cover the outer circumference of the shaft tip portion 12 and a feeding mechanism portion 64 illustrated in FIGS. 29 to 31 disposed between the shaft tip portion 12 and the outer member 50. The rotation operating portion 63*a* moves the outer member 50 by being rotated in the circumferential direction. The feeding mechanism portion 64 moves the position of the outer member 50 back and forth with rotation of the rotation operating portion 63*a*.

Specifically, the feeding mechanism portion 64 includes a cam hole 15*a* (see FIG. 29) formed on a side surface of the shaft tip portion 12, a pin 55*a* (see FIGS. 30 and 31) provided on the outer member 50, and a long hole 63A (see FIG. 30) formed on a side surface of the rotation operating portion 63*a*. As illustrated in FIG. 29, the cam hole 15*a* is formed obliquely in a direction crossing the axial direction of the shaft tip portion 12 so that the distance from the tip end of the shaft tip portion 12 at one end portion is different from the distance from the tip end of the shaft tip portion 12 at the other end portion. Moreover, the long hole 63A is so formed that the length direction extends in the axial direction of the rotation operating portion 63*a* as illustrated in FIG. 30. The pin 55*a* protrudes in the direction vertical to the shaft from the rear side surface of the outer member 50. Further, as illustrated in FIG. 31, the pin 55*a* passes through the cam hole 15*a* and engages with the long hole 63A illustrated in FIG. 30. Further, when the rotation operating portion 63*a* is rotated around the axial direction, the pin 55*a* moves along the cam hole 15*a* and the outer member 50 moves back and forth. That is, when the rotation operating portion 63*a* is rotated in the direction indicated by a black arrow illustrated in FIG. 30, the pin 55*a* moves through the cam hole 15*a* in a direction away from a tip end of the shaft tip portion 12 and the outer member 50 moves toward the rear side. On the other hand, when the rotation operating portion 63*a* is rotated in the direction indicated by a white arrow illustrated in FIG. 30, the pin 55*a* moves through the cam hole 15*a* in a direction toward the tip end of the shaft tip portion 12 and the outer member 50 moves toward the front side.

A method of using the ballpoint pen 1 having the above-described configuration will be described based on FIGS. 28A and 28B.

FIG. 28A illustrates a state where the positional relation between the outer member 50 and the holder 21 is at the holder protruding position. In this state, the length from the tip end of the front shaft portion 12 to the outer member tip end portion 51 is "c." When a user writes lines using the ballpoint pen 1 in such a state, the writing ball 30 and the outer member tip end portion 51 will not make contact with the writing surface simultaneously. Thus, it is possible to draw a line having the width w1 illustrated in FIG. 25 with the ink adhering to the surface of the writing ball 30. On the other hand, when the positional relation between the outer member 50 and the holder 21 is at the holder protruding position, and the rotation operating portion 63*a* is rotated in a predetermined direction, the outer member 50 moves toward the tip end side and is positioned at the holder retracting position. In this state, as illustrated in FIG. 28B, the length from the tip end of the front shaft portion 12 to the outer member tip end portion 51 is "d" longer than the length "c." When a user writes lines using the ballpoint pen 1 in such a state, the writing ball 30 and the outer member tip end portion 51 can make contact with the writing surface simultaneously. Thus, it is possible to draw a bold line having the width w2 illustrated in FIG. 26 with the ink diffusing between the writing ball 30 and the outer member tip end portion 51 according to capillary phenomenon. It is naturally possible to draw a narrow line having the width w1 even at the holder retracting position when the user puts the shaft tube 10 in a vertically standing state.

According to the present embodiment, since a state where narrow lines can be drawn and a state where bold lines can be drawn can be selected in advance, it is not necessary to change writing load in the middle of writing and users can write lines with constant writing load. Moreover, the width of lines may not be changed unintentionally with a change in the writing load during writing. In particular, in the holder retracting position, by maintaining the angle of the writing tip to be constant, it is possible to draw bold lines stably without changing the writing load.

Further, according to the present embodiment, since the pin 55*a* is visible from the long hole 63A of the rotation operating portion 63*a*, it is possible to immediately recognize whether the writing tip state (the positional relation between the outer member 50 and the holder 21) is at the holder protruding position or the holder retracting position. That is, when the writing tip state is at the holder protruding position, the pin 55*a* is positioned on the front side of the long hole 63A. In contrast, when the writing tip state is at the holder retracting position, the pin 55*a* is positioned on the rear side of the long hole 63A. Thus, it is possible to recognize the writing tip state.

Moreover, the means for displacing the outer member 50 is not limited to the rotary feeding mechanism 62*a*, but for example, a knob may be slid to allow the outer member 50 to protrude and retract. Alternatively, a male screw and a female screw may be formed on the outer circumference of the outer member 50 and the inner circumference of the front shaft portion 12 and the outer member 50 may be moved in the axial direction by rotating the outer member 50. Furthermore, in the sixth embodiment, a feeding mechanism may be used as the means for moving the joint 14 and the pen tip 20.

(Eighth Embodiment)

Figure 32:
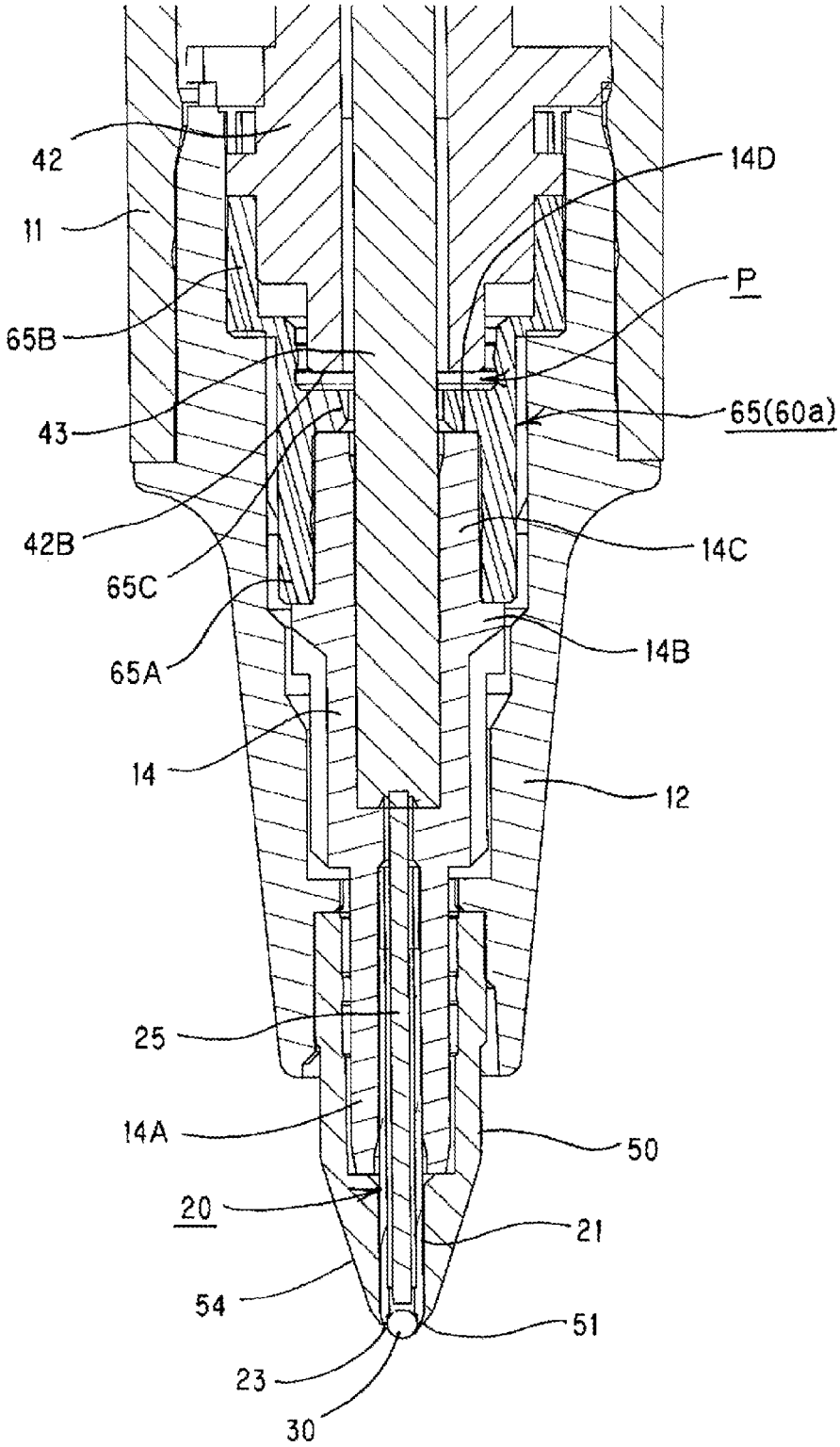
FIG. 32 is a vertical cross-sectional view of a tip portion of a ballpoint pen according to an eighth embodiment of the present invention.

FIG. 32 illustrates the eighth embodiment of the present invention.

In the present embodiment, the configuration of the elastic member of the sixth embodiment is changed. The elastic member is the O-shaped ring 61*a* in the sixth embodiment, and is an elastic joint 65 in the present embodiment.

In the present embodiment, as illustrated in FIG. 32, a rear end portion 14C of the joint 14 is separated from the tip end portion of the tip holding portion 42 of the ink supply portion 40, and the elastic joint 65 is interposed as a means for connecting the joint 14 and the tip holding portion 42. That is, the elastic joint 65 includes a front tube portion 65A and a rear tube portion 65B having a slightly larger diameter than the front tube portion 65A, the rear end portion of the joint 14 is fitted into the front tube portion 65A, and the front end portion of the tip holding portion 42 is fitted into the rear tube portion 65B. Moreover, a flange-shaped inner protrusion 65C that protrudes toward the center and makes contact with a rear end surface 14D of the joint 14 is formed inside the elastic joint 65. A gap P is formed between a rear end of the inner protrusion 65C and a tip end surface 42B of the tip holding portion 42. That is, the inner protrusion 65C is sandwiched between the tip end surface 42B of the tip holding portion 42 and the rear end surface 14D of the joint 14 and makes contact with the rear end surface 14D of the joint 14.

Further, when writing load is applied to the writing tip, the inner protrusion 65C pressed toward the rear side by the joint 14 bends toward the rear side, and the writing tip can move toward the rear side. In this case, the gap P narrows. That is, the gap P is a space portion for allowing deformation of the inner protrusion 65C. When the load applied to the writing tip decreases, the joint 14 is pushed back to return to the original position by the restoring force of the inner protrusion 65C.

The elastic joint 65 as the elastic member may be formed from a material that allows the inner protrusion 65C to be bent with writing load and may be preferably formed from rubber, a rubber-like elastic material such as elastomer, and a relatively soft resin material such as polypropylene.

When the elastic member can be deformed with very small load, the first writing portion can be put into the retracting position and users can draw bold lines constantly without experiencing discomfort during writing. Moreover, when the writing portion becomes distant from the writing surface for example, when a user creates strokes such as "hook" and "fade" and the writing load decreases, the first writing portion continuously moves from the retracting position to the protruding position, whereby a bold line changes to a narrow line continuously and smoothly. Moreover, by changing a volume associated with deformation of the shape of the elastic member to allow an ink passage to be pressed by the writing load, it is possible to provide satisfactory ink flowability during initial writing.

(Ninth Embodiment)

Figure 33:
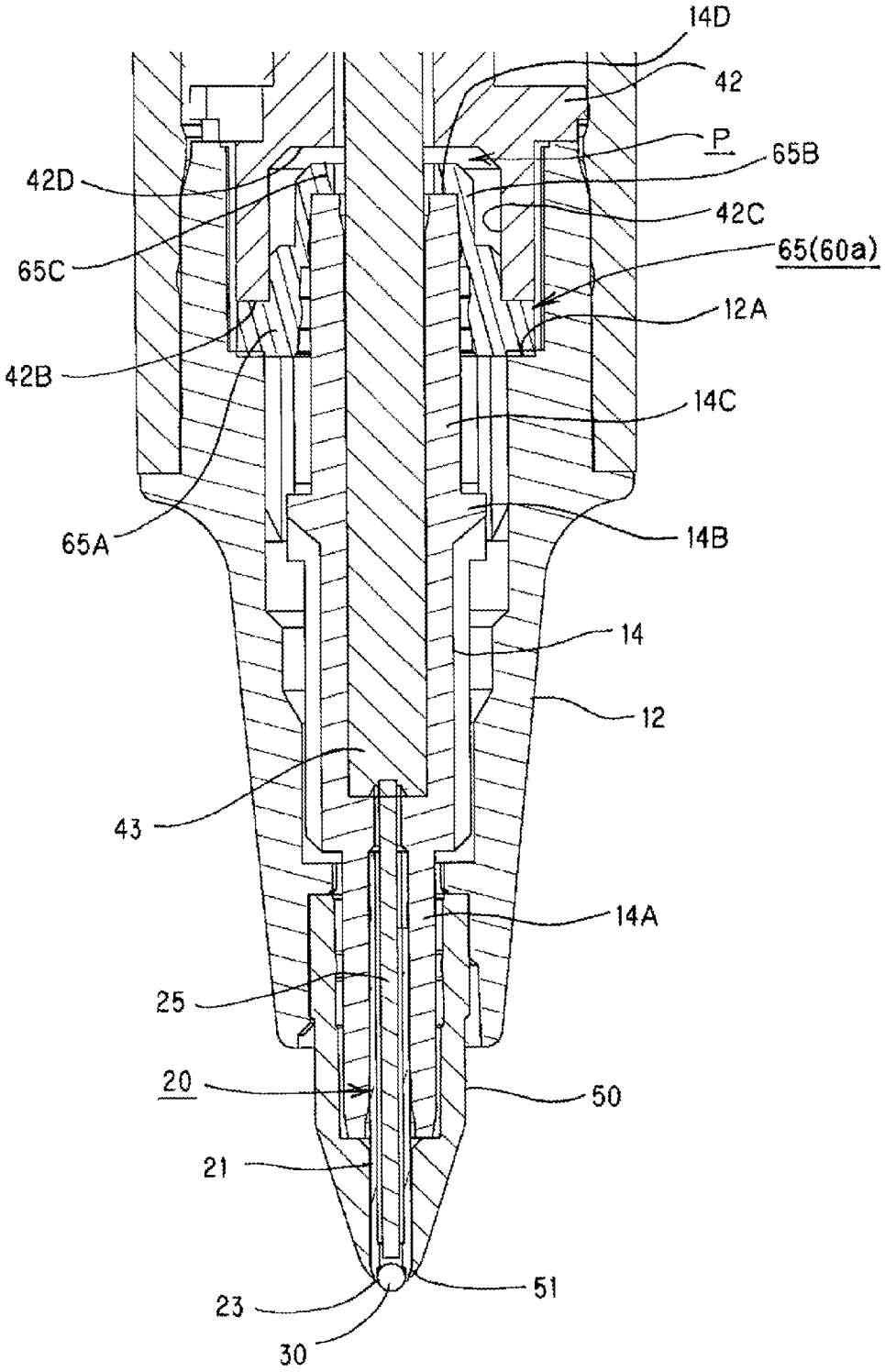
FIG. 33 is a vertical cross-sectional view of a tip portion of a ballpoint pen according to a ninth embodiment of the present invention.

FIG. 33 illustrates the ninth embodiment of the present invention.

In the present embodiment, the shape of the elastic joint 65 as the elastic member of the eighth embodiment is changed.

In the present embodiment, as illustrated in FIG. 33, the rear end portion 14C of the joint 14 is inserted into the tip end portion of the tip holding portion 42 of the ink supply portion 40, and the elastic joint 65 is interposed between the rear end portion and the tip end portion. That is, the elastic joint 65 includes a front tube portion 65A and a rear tube portion 65B having a slightly smaller diameter than the front tube portion 65A. The rear tube portion 65B is fitted into a recess portion 42C formed in the tip end portion of the tip holding portion 42, and the front tube portion 65A is sandwiched between the tip end surface 42B of the tip holding portion 42 and a step 12A formed on the inner circumference on the rear side of the front shaft portion 12. Moreover, a flange-shaped inner protrusion 65C that protrudes toward the center and makes contact with a rear end surface 14D of the joint 14 is formed on the rear end portion of the rear tube portion 65B. Further, a gap P is formed between the rear end surface of the elastic joint 65 (the rear end surface of the inner protrusion 65C) and a recess bottom 42D of the recess portion 42C of the tip holding portion 42.

Further, when writing load is applied to the writing tip, the inner protrusion 65C pressed toward the rear side by the joint 14 bends toward the rear side, and the writing tip can move toward the rear side. When the load applied to the writing tip decreases, the joint 14 is pushed back to return to the original position by the restoring force of the inner protrusion 65C.

(Tenth Embodiment)

Figure 34:
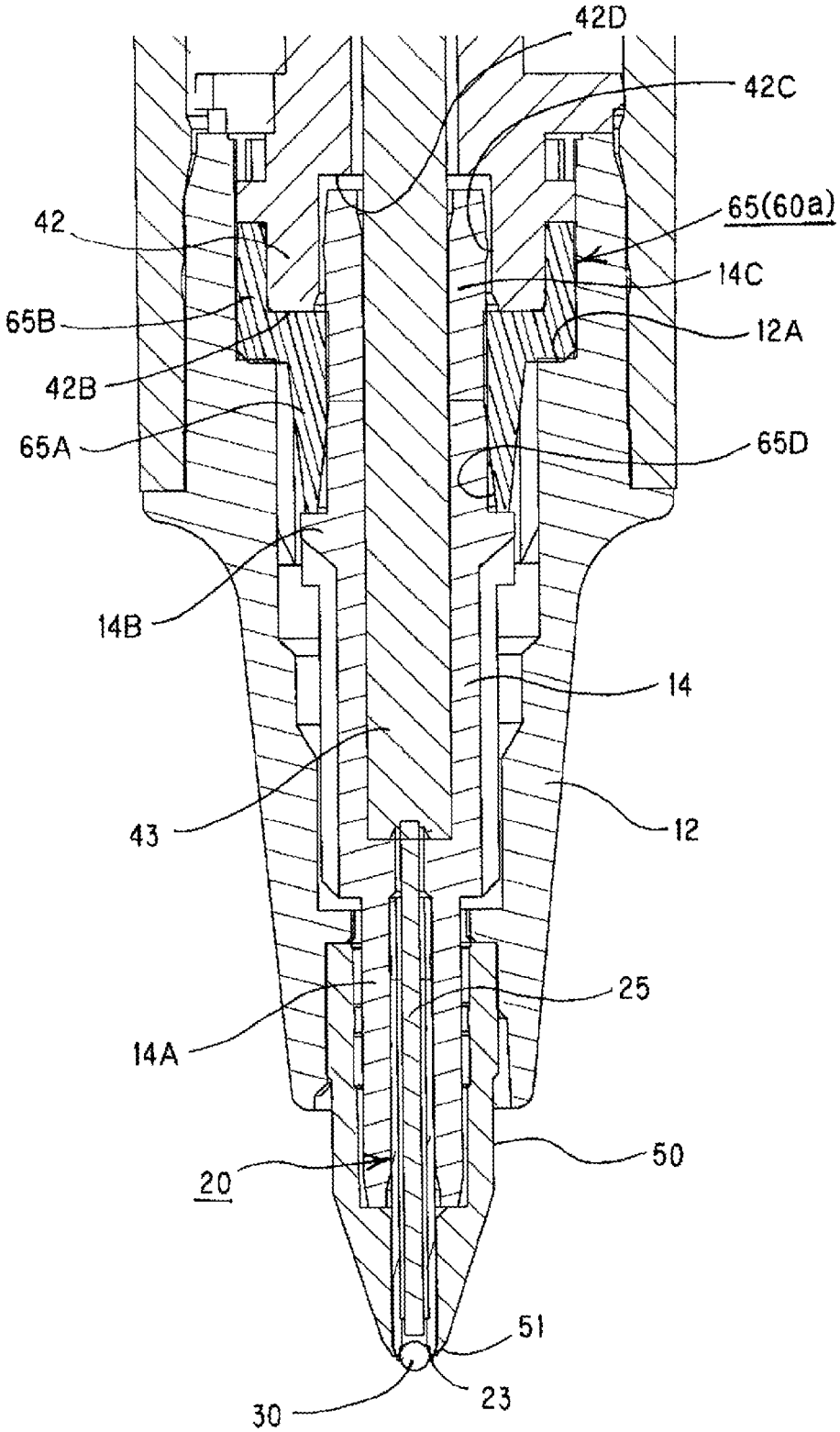
FIG. 34 is a vertical cross-sectional view of a tip portion of a ballpoint pen according to a tenth embodiment of the present invention.

FIG. 34 illustrates the tenth embodiment of the present invention.

In the present embodiment, an elastic joint 65 is provided as the elastic member. In the present embodiment, as illustrated in FIG. 34, the rear end portion 14C of the joint 14 is inserted into a recess portion 42C formed in the tip end portion of the tip holding portion 42 of the ink supply portion 40, and the elastic joint 65 covers the tip end portion of the tip holding portion 42 and the rear end portion 14C of the joint 14 protruding from the tip holding portion 42. That is, the elastic joint 65 includes a front tube portion 65A and a rear tube portion 65B having a slightly larger diameter than the front tube portion 65A, the rear end portion 14C of the joint 14 is fitted into the front tube portion 65A, and the front end portion of the tip holding portion 42 is fitted into the rear tube portion 65B. Moreover, a tapered portion 65D of which the inner diameter decreases toward the rear end side is provided on the inner circumference of the front tube portion 65A. That is, the front tube portion 65A is so formed that the thickness decreases toward the tip end side. Moreover, the front end portion of the elastic joint 65 (the front end portion of the front tube portion 65A) is in contact with the rear end of the flange portion 14B of the joint 14, and the rear tube portion 65B is sandwiched between the tip end portion of the tip holding portion 42 and the step 12A formed on the inner circumference on the rear end side of the front shaft portion 12.

Further, when writing load is applied to the writing tip, a thin portion of the front tube portion 65A pressed toward the rear side by the flange portion 14B of the joint 14 is deformed and the writing tip can move toward the rear side. When the load applied to the writing tip decreases, the joint 14 is pushed back to return to the original position by the restoring force of the front tube portion 65A.

(Eleventh Embodiment)

FIGS. 35A and 35B and FIGS. 36A and 36B illustrate the eleventh embodiment of the present invention.

Figure 35A:
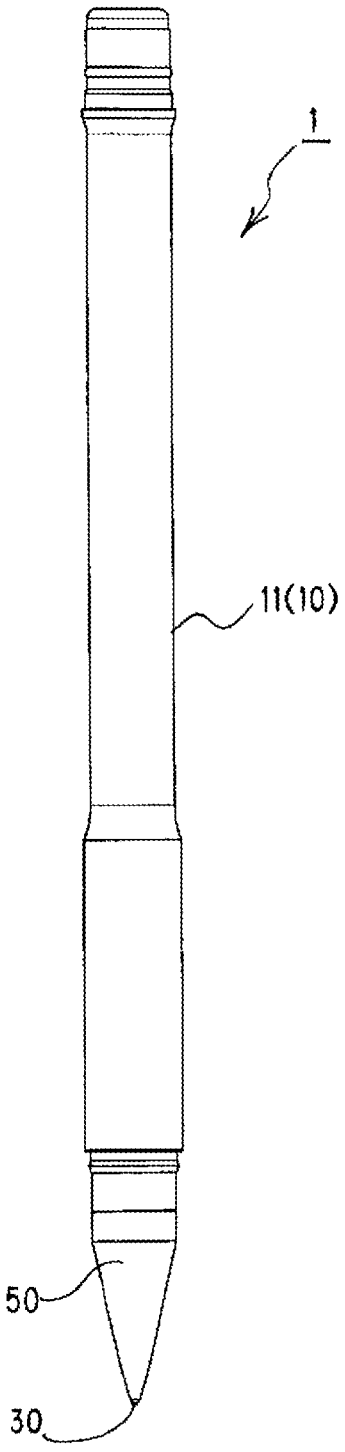
FIGS. 35A and 35B are a front view and a vertical cross-sectional view of a ballpoint pen according to an eleventh embodiment of the present invention, respectively.
Figure 35B:
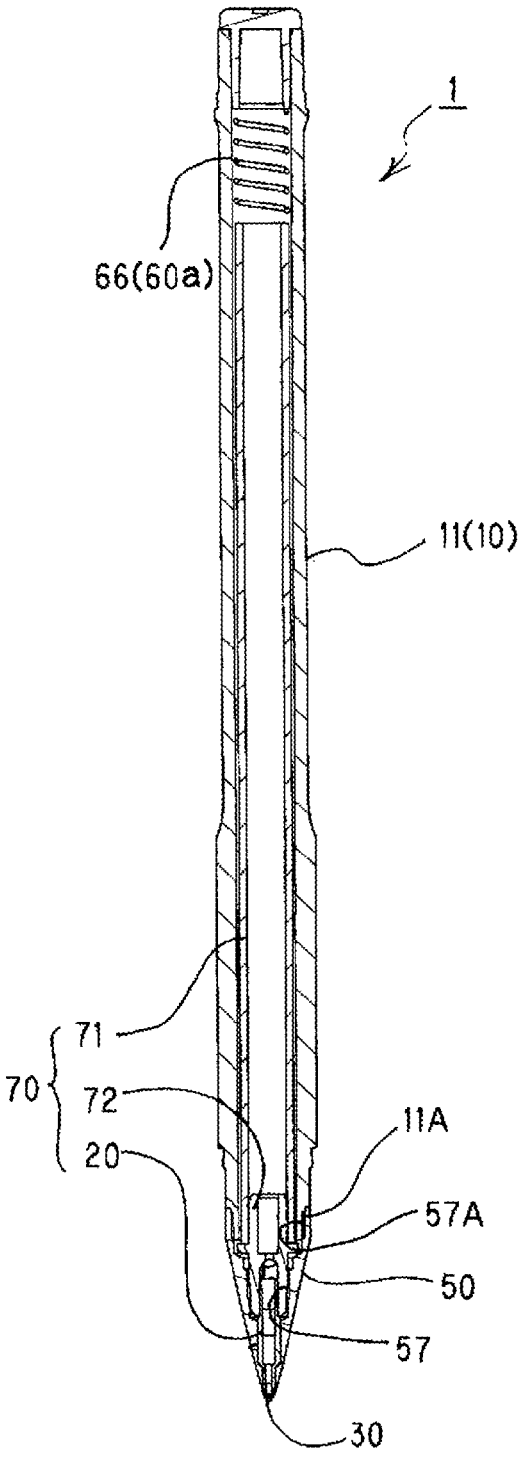

As illustrated in FIGS. 35A and 35B, the ballpoint pen 1 according to the eleventh embodiment has an ink refill 70 to which the pen tip 20 is fixed and which is stored in the shaft tube 10.

Figure 36A:
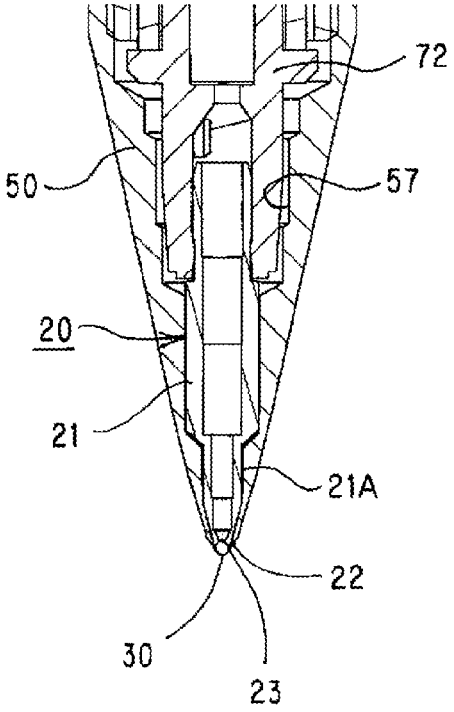
Figure 36B:
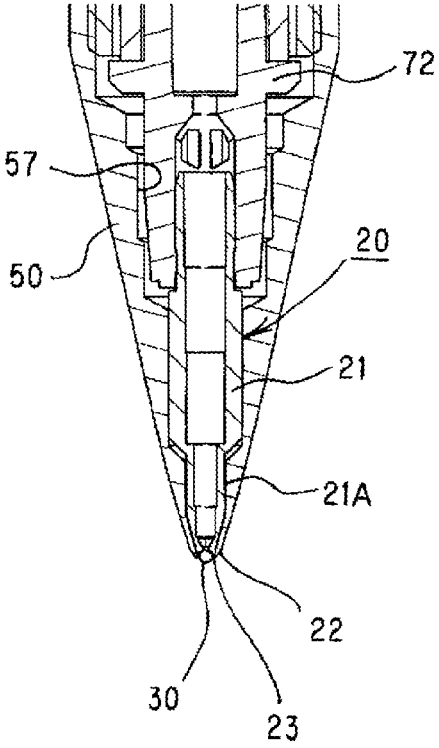

As illustrated in FIGS. 36A and 36B, the pen tip 20 of the present embodiment has a small-diameter portion 21A formed in a tip end portion of the cylindrical holder 21 and a tapered portion 22 and a narrowed portion 23 which are provided in the tip end of the small-diameter portion 21A and in which the writing ball 30 is held. The holder 21 is hollow and is filled with ink during writing.

As illustrated in FIG. 35B, the ink refill 70 includes an ink storage tube 71 in which ink is filled, a joint 72 fixed to the tip end of the ink storage tube 71, and a pen tip 20 fixed to the joint 72. The ink storage tube 71 is a polypropylene tube in which ink (not illustrated) and an ink following body for preventing ink leakage are filled. The joint 72 is a tubular member which has an opening that extends in a front-to-rear direction and of which the rear portion is press-fitted into the ink storage tube 71. The pen tip 20 is press-fitted into the front opening of the joint 72 exposed from the ink storage tube 71, and the ink in the ink storage tube 71 is supplied to the pen tip 20 from the rear opening. As illustrated in FIG. 35B, the ink refill 70 has the ink storage tube 71 stored in the shaft body 11, and the joint 71 and the pen tip 20 exposed from the joint 71 are covered by the outer member 50.

In the present embodiment, the outer member 50 is formed in an approximately conical form so as to be tapered toward the tip end. As illustrated in FIG. 35B and FIGS. 36A and 36B, an insertion hole 57 that passes from the rear side to the tip end side is formed in the outer member 50. Moreover, as illustrated in FIG. 35B, a screw portion 57A is formed on an inner circumferential surface on the rear side of the insertion hole 57. Further, a screw portion 11A formed on the outer circumference on the tip end side of the shaft body 11 engages with the screw portion 57A whereby the outer member 50 is fixed. That is, in the present embodiment, the outer member 50 also serves as a front shaft portion.

In the present embodiment, as illustrated in FIG. 35B, a spring 66 as an elastic member is disposed on the rear side of the ink refill 70. The spring 66 is a compression coil spring that biases the ink storage tube 71 toward the tip end side, and in a normal state, the ink refill 70 is at the holder protruding position illustrated in FIG. 36A. Further, when writing load is applied to the writing tip, the spring 66 is compressed by the rear end portion of the ink storage tube 71 and the entire ink refill 70 moves toward the rear side and is positioned at the holder retracting position illustrated in FIG. 36B. When the load applied to the writing tip decreases, the ink refill 70 is pushed back to return to the original position by the restoring force of the spring 66. The elastic member is not limited to the spring 66 but a member which is restored according to elastic action may be used. For example, an elastic body formed from rubber or a rubber-like elastic material such as elastomer may be used.

(Twelfth Embodiment)

Figure 37A:
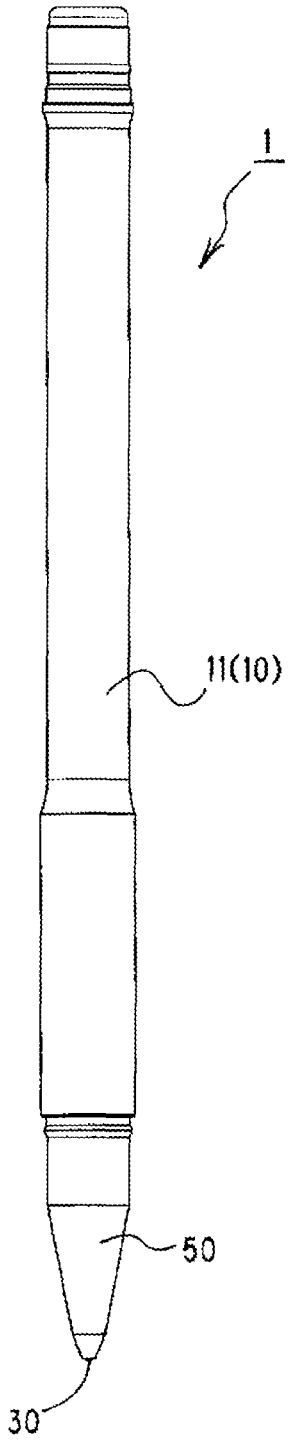
FIGS. 37A and 37B are a front view and a vertical cross-sectional view of a ballpoint pen according to a twelfth embodiment of the present invention, respectively.
Figure 37B:
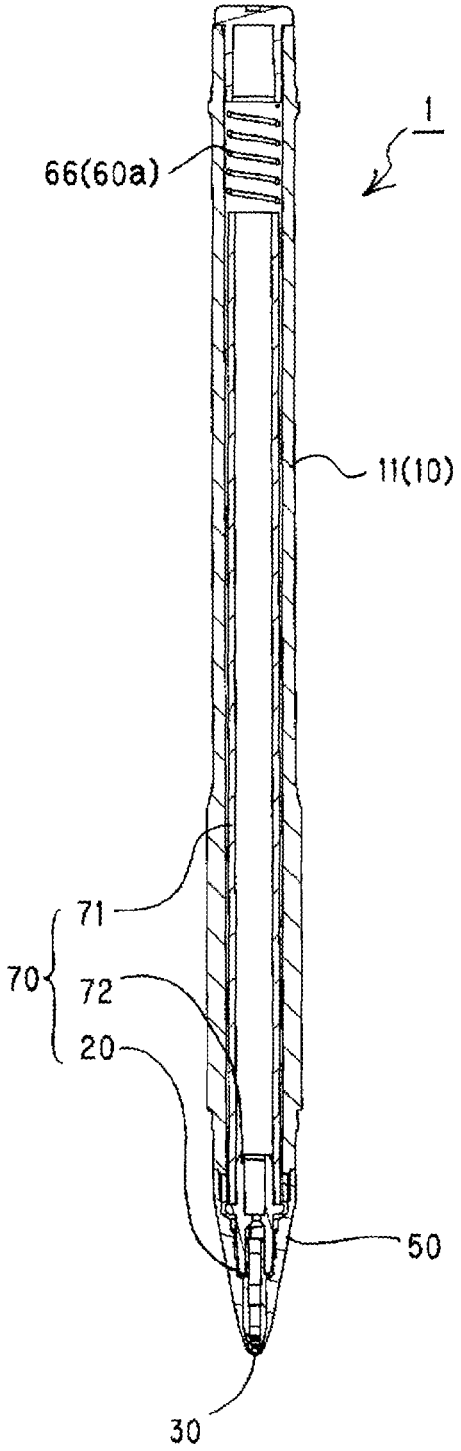
Figure 38:
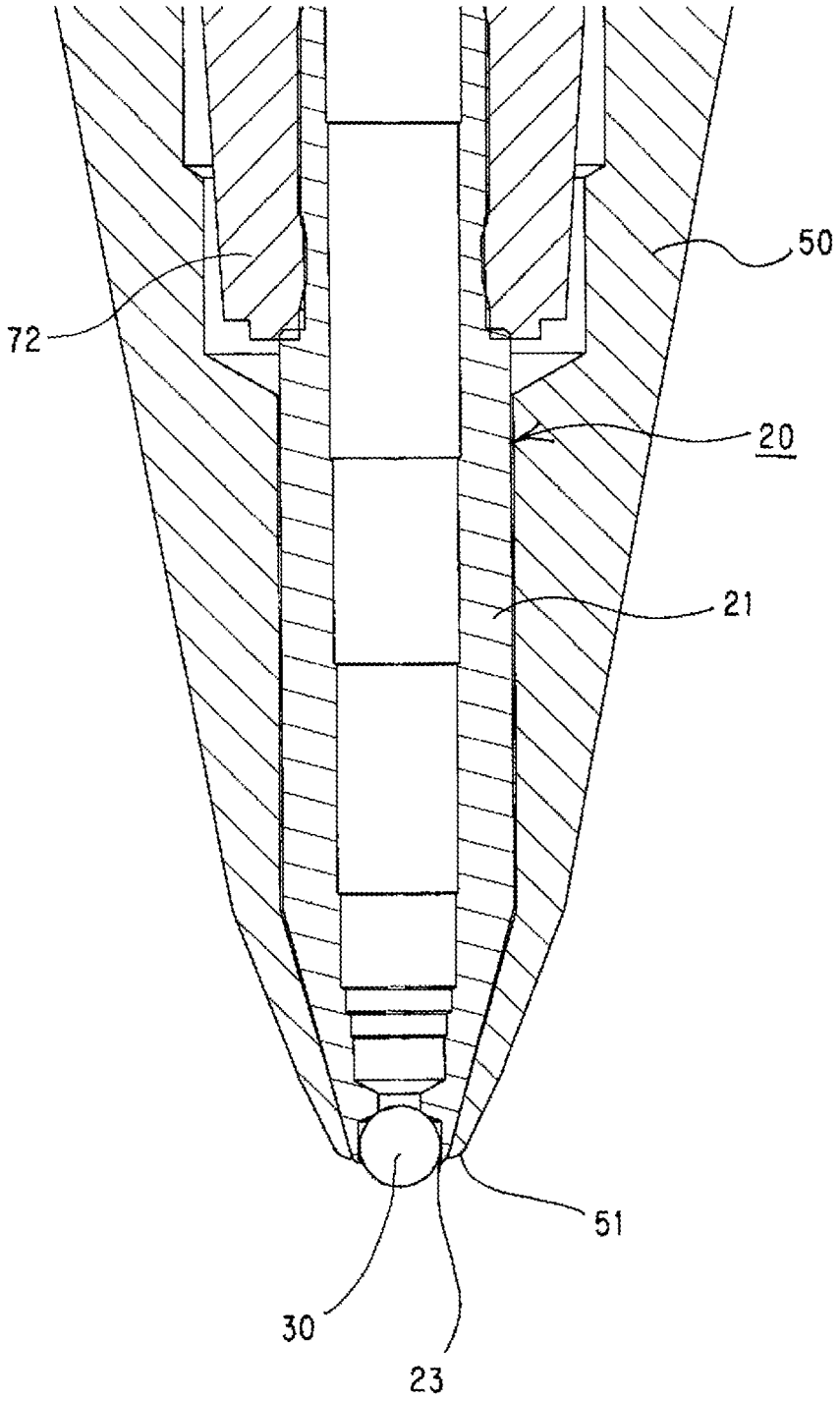
FIG. 38 is a vertical cross-sectional view of a tip portion of the ballpoint pen according to the twelfth embodiment.

FIGS. 37A and 37B and FIG. 38 illustrate the twelfth embodiment of the present invention.

A ballpoint pen 1 according to the present embodiment has a writing ball 30 having a larger diameter than the writing ball 30 of the eleventh embodiment. The other configuration is the same as that of the eleventh embodiment except that, since the diameter of the tip end portion of the pen tip 20 is larger than that of the eleventh embodiment, the taper angle of the outer member 50 is gentle, and a tapered portion having a different angle is provided in the tip end portion of the outer member 50.

As described above, in the present invention, the shape of the pen tip 20 is not particularly limited as long as lines can be written with the pen tip.

(Thirteenth Embodiment)

FIGS. 39A and 39B to FIG. 41 illustrate the thirteenth embodiment of the present invention.

Figure 39A:
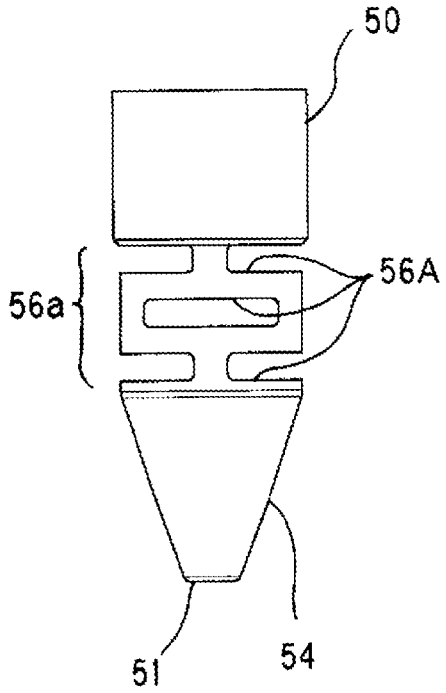
FIGS. 39A and 39B are a front view and a perspective view of an outer member according to a thirteenth embodiment of the present invention, respectively.
Figure 39B:
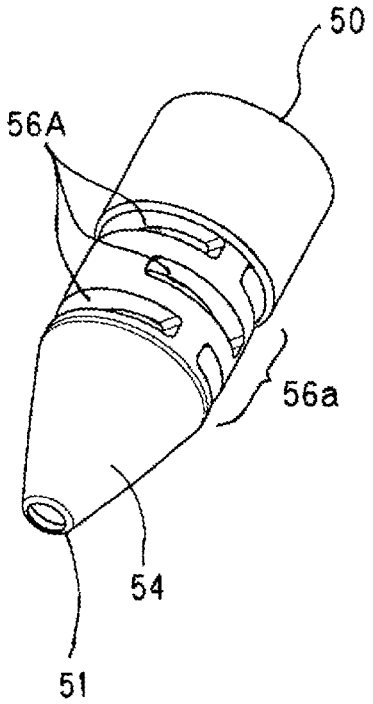

In the present embodiment, a displacement means 60*a* is formed in the outer member 50. As illustrated in FIGS. 39A and 39B, the outer member 50 of the present embodiment includes a compression portion 56*a* in which a plurality of slits 56A is formed in a central portion between the tip end portion and the rear end portion. The slits 56A are so formed as to pass through the cylindrical outer member 50 from the side surface and three stages of slits 56A are positioned in a staggered manner. Due to the slits 56A, when pressure is applied in the axial direction of the outer member 50, the compression portion 56*a* is deformed and the entire length of the outer member 50 decreases.

Figure 40:
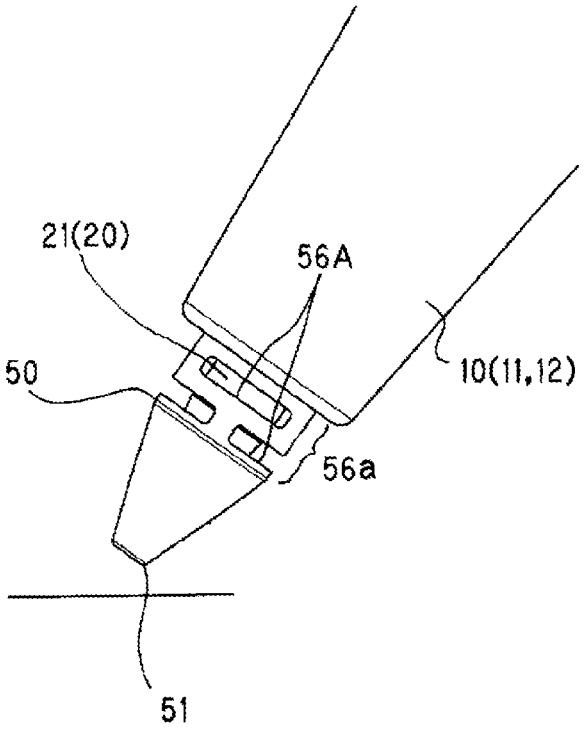
FIG. 40 is a front view illustrating a normal state during writing according to the thirteenth embodiment.

Moreover, in the present embodiment, as illustrated in FIG. 40, in a normal state, the tip end portion of the pen tip 20 does not protrude from the outer member tip end portion 51. Similarly to the sixth to tenth embodiments, the outer member 50 may be attached to the front shaft portion 12 and may be attached to the tip end portion of the shaft body 11 (that is, the outer member 50 may also serve as the front shaft portion 12). The outer member 50 may be attached directly to the pen tip.

Figure 41:
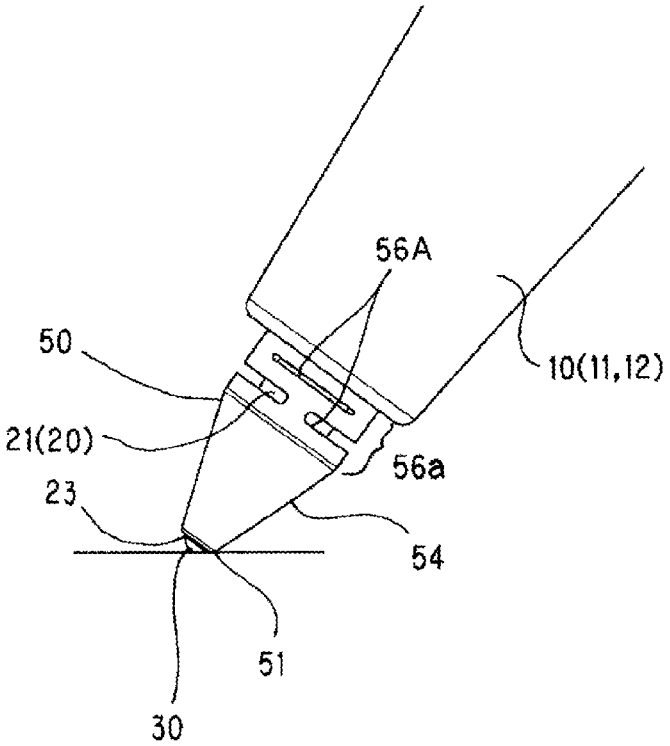
FIG. 41 is a front view illustrating a state where a writing load is applied during writing according to the thirteenth embodiment.

Further, when the outer member tip end portion 51 is pressed against the writing surface during writing, as illustrated in FIG. 41, the slits 56A of the compression portion 56*a* are compressed, the length of the outer member 50 decreases, and the tip end portion (the writing ball 30 and the narrowed portion 23) of the pen tip 20 is exposed. In this case, the writing tip is at the position as illustrated in FIG. 26 of the sixth embodiment. When the writing tip is separated from the writing surface, the length of the outer member 50 restores the original length by the restoring force of the compression portion 56*a*, and the tip end portion of the pen tip 20 is retracted toward the inside of the outer member 50.

According to the present embodiment, since it is not necessary to provide the elastic member in the shaft tube 10, it is easy to manufacture the ballpoint pen. Moreover, when the outer member 50 is formed to be fixed by being screwed into the shaft body 11, it is possible to replace the outer member 50 easily even when the compression portion 56*a* is broken.

(Fourteenth Embodiment)

Figure 42A:
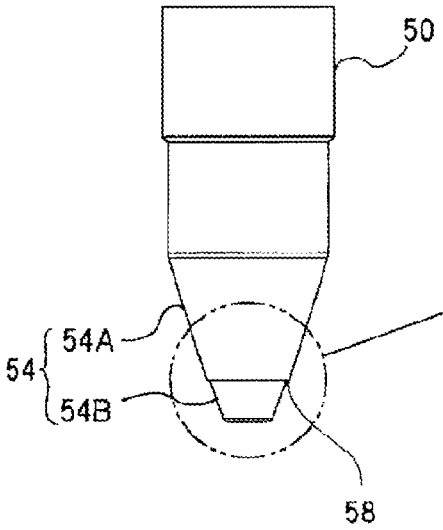
FIGS. 42A and 42B are a front view of an outer member and an enlarged view of a tip portion of the outer member according to a fourteenth embodiment of the present invention.
Figure 42B:
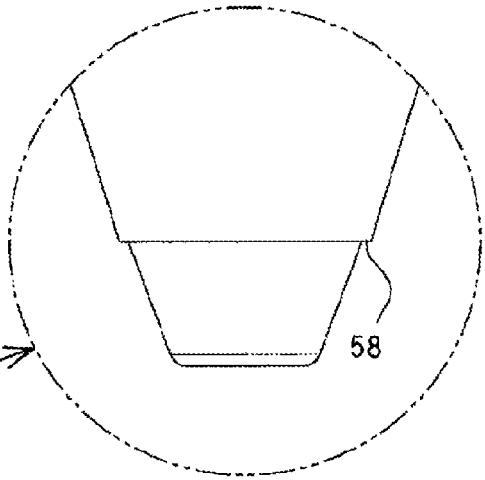

FIGS. 42A and 42B illustrate the fourteenth embodiment of the present invention.

In the present embodiment, a step portion 58 is formed on the surface of the outer member 50 to prevent ink contamination of the rear side. As illustrated in FIGS. 42A and 42B, the step portion 58 is formed by narrowing a portion of the outer member 50 close to the tip end of the tapered portion 54. Due to the step portion 58, it is possible to prevent ink adhering to a tapered portion 54B closer to the tip end than the step portion 58 from diffusing toward a tapered portion 54A closer to the rear side than the step portion 58 and to prevent a portion of the outer member 50 close to the tip end from being contaminated.

The step portion 58 of the present embodiment can be also applied to the sixth to thirteenth embodiments.

(Comparison with Other Writing Instruments)

Figure 43:
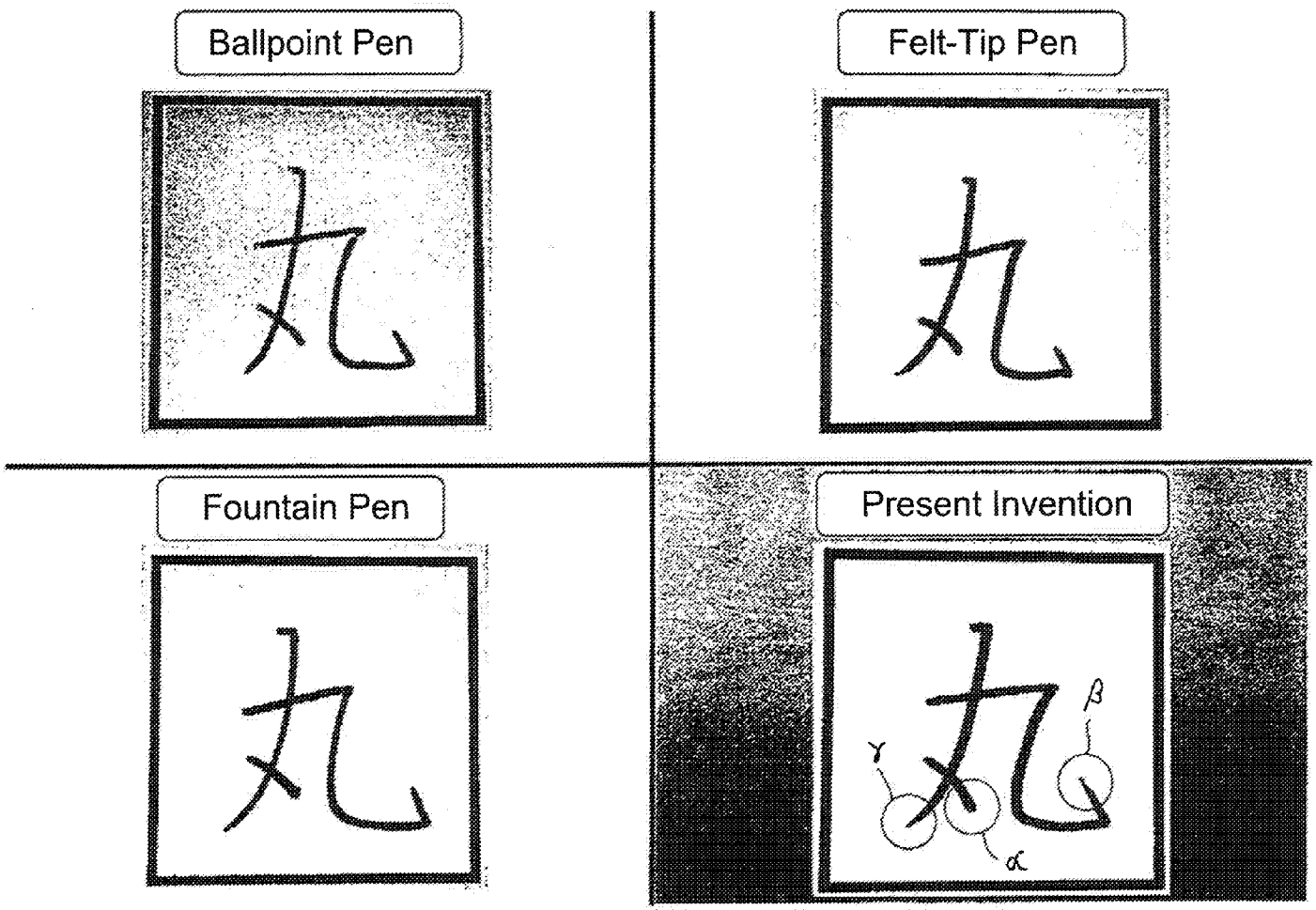
FIG. 43 illustrates a character written by the present invention and characters written by conventional writing instruments.

FIG. 43 illustrates handwritings written by a ballpoint pen, a felt-tip pen, a fountain pen, and the ballpoint pen 1 according to the present invention. As can be understood from the handwriting written by the ballpoint pen 1 according to the present invention, the ballpoint pen 1 can create strokes α "stop," β "hook," and γ "fade" which are the ends of strokes more easily and with higher quality than the ballpoint pen, the felt-tip pen, and the fountain pen. In particular, since the writing load applied to the writing tip at the ends of strokes can be smoothly changed with the elastic member in the shaft tube as compared to the conventional writing instruments, it is possible to create brush-like strokes "stop," "hook," and "fade."

As described above, in the first to fifth embodiments, due to the pen tip 20 and the outer member 50, it is possible to write drawn lines of different widths with one writing tip and to improve the expressive power of handwriting.

Moreover, in the sixth to fourteenth embodiments, due to the two writing portions made up of the first and second writing portions, it is possible to write drawn lines of different widths with one writing ball and to improve the expressive power of handwriting.

INDUSTRIAL APPLICABILITY

The present invention can be used for writing instruments such as a ballpoint pen.

The invention claimed is:

1. A ballpoint pen configured to be capable of writing drawn lines of different widths using two writing portions; comprising:

a writing ball;

a first writing portion holding the writing ball by a narrowed portion with a narrowed tip end;

an ink supply portion supplying ink to the first writing portion;

a shaft tube storing the ink supply portion therein; and a second writing portion covering an outer circumference of the first writing portion, a part of the second writing portion and a part of the first writing portion holding the writing ball being exposed from a tip end portion of the shaft tube;

a displacement means capably changing a relative positional relation in an axial direction between the first writing portion and the second writing portion;

the displacement means being formed so that, when a relative position of the first writing portion in relation to the second writing portion is at a retracting position of the first writing portion, a tip end portion of the first writing portion and a tip end portion of the second writing portion can make contact with the writing surface simultaneously.

2. The ballpoint pen according to claim 1, wherein the displacement means is an elastic member disposed on a rear side of the first writing portion and is capable of displacing the relative position of the first writing portion in relation to the second writing portion between a retracting position of the first writing portion at which the tip end portion of the second writing portion covers a portion of the writing ball reaching the narrowed portion and a protruding position of the first writing portion at which the tip end portion of the second writing portion is located closer to the rear side than the retracting position of the first writing portion; and the displacement means is formed so that, when load is applied to the first writing portion from the tip end thereof at an initial position at which the first writing portion is at the protruding position, the elastic member is compressed and deformed, whereby the first writing portion is moved toward the rear side and the first writing portion is moved to the retracting position of the first writing portion.

3. The ballpoint pen according to claim 1, wherein the displacement means is a feeding mechanism provided in the tip end portion of the shaft tube; and the feeding mechanism is so formed as to capably move the second writing portion between the protruding position of the first writing portion and the retracting position of the first writing portion according to a predetermined operation.

4. The ballpoint pen according to claim 3, wherein the ink has such viscosity that the ink can diffuse between a contact portion of the writing ball with a writing surface and a contact portion of the tip end portion of the second writing portion with the writing surface in a state where the writing ball and the tip end portion of the second writing portion are in contact with the writing surface simultaneously.

5. A ballpoint pen configured to be capable of writing drawn lines of different widths using two writing portions, comprising:

a writing ball;

a first writing portion holding the writing ball by a narrowed portion with a narrowed tip end;

an ink supply portion supplying ink to the first writing portion;

a shaft tube storing the ink supply portion therein; and a second writing portion molded together with the shaft tube to form a tip end portion of the shaft tube and covering an outer circumference of the first writing portion, a part of the first writing portion holding the writing ball being exposed from a tip end portion of the second writing portion;

a displacement means capably changing a relative positional relation in an axial direction between the first writing portion and the second writing portion;

the displacement means being formed so that, when a relative position of the first writing portion in relation to the second writing portion is at a retracting position of the first writing portion, a tip end portion of the first writing portion and a tip end portion of the second writing portion can make contact with the writing surface simultaneously.

6. The ballpoint pen according to claim 5, wherein the displacement means is an elastic member disposed on a rear side of the first writing portion and is capable of displacing the relative position of the first writing portion in relation to the second writing portion between a retracting position of the first writing portion at which the tip end portion of the second writing portion covers a portion of the writing ball reaching the narrowed portion and a protruding position of the first writing portion at which the tip end portion of the second writing portion is located closer to the rear side than the retracting position of the first writing portion; and the displacement means is formed so that, when load is applied to the first writing portion from the tip end thereof at an initial position at which the first writing portion is at the protruding position, the elastic member is compressed and deformed, whereby the first writing portion is moved toward the rear side and the first writing portion is moved to the retracting position of the first writing portion.

7. The ballpoint pen according to claim 5, wherein the displacement means is a feeding mechanism provided in the tip end portion of the shaft tube; and the feeding mechanism is so formed as to capably move the second writing portion between the protruding position of the first writing portion and the retracting position of the first writing portion according to a predetermined operation.

8. The ballpoint pen according to claim 7, wherein the ink has such viscosity that the ink can diffuse between a contact portion of the writing ball with a writing surface and a contact portion of the tip end portion of the second writing portion with the writing surface in a state where the writing ball and the tip end portion of the second writing portion are in contact with the writing surface simultaneously.

* * * * *